US008938857B2

(12) United States Patent
Motosugi et al.

(10) Patent No.: US 8,938,857 B2
(45) Date of Patent: Jan. 27, 2015

(54) SLIDE HINGE

(71) Applicants: Katoh Electrical Machinery Co., Ltd., Kanagawa (JP); Toppan Cosmo, Inc., Tokyo (JP); The Hard Industries. Inc., Osaka (JP)

(72) Inventors: Hideki Motosugi, Kanagawa (JP); Takashi Yamato, Tokyo (JP); Hozumi Ikuta, Osaka (JP)

(73) Assignees: Katoh Electrical Machinery Co., Ltd., Kanagawa (JP); Toppan Cosmo, Inc., Tokyo (JP); The Hard Industries. Inc., Osaka (JP)

( * ) Notice: Subject to any disclaimer, the term of this patent is extended or adjusted under 35 U.S.C. 154(b) by 0 days.

(21) Appl. No.: 14/044,510

(22) Filed: Oct. 2, 2013

(65) Prior Publication Data

US 2014/0096343 A1 Apr. 10, 2014

(30) Foreign Application Priority Data

Oct. 4, 2012 (JP) ..... 2012-222348
Sep. 12, 2013 (JP) ..... 2013-189528

(51) Int. Cl.
*E05D 5/00* (2006.01)
*E05D 5/02* (2006.01)
*E05D 5/08* (2006.01)

(52) U.S. Cl.
CPC ..... *E05D 5/0276* (2013.01); *E05D 5/08* (2013.01); *E05Y 2600/504* (2013.01)
USPC ..... 16/382; 16/384

(58) Field of Classification Search
USPC ..... 16/284, 352, 354, 362, 382, 384, 387, 16/388
See application file for complete search history.

(56) References Cited

U.S. PATENT DOCUMENTS

| | | | | | |
|---|---|---|---|---|---|
| 4,185,357 | A | * | 1/1980 | Busse | 16/265 |
| 4,270,240 | A | * | 6/1981 | Zernig et al. | 16/250 |
| 4,590,641 | A | * | 5/1986 | Lautenschlager et al. | 16/238 |
| 4,604,769 | A | * | 8/1986 | Rock et al. | 16/238 |
| 4,620,343 | A | * | 11/1986 | Grass | 16/236 |
| 5,245,727 | A | * | 9/1993 | Sasaki | 16/258 |
| 5,548,870 | A | * | 8/1996 | Grass | 16/254 |
| 5,561,888 | A | * | 10/1996 | Lautenschlager | 16/383 |
| 7,017,231 | B2 | * | 3/2006 | Isele | 16/242 |
| 7,480,962 | B2 | * | 1/2009 | Takamatsu et al. | 16/382 |

FOREIGN PATENT DOCUMENTS

| | | | |
|---|---|---|---|
| JP | 3090408 | U | 9/2002 |
| JP | 2003-90167 | A | 3/2003 |

* cited by examiner

*Primary Examiner* — Roberta Delisle
(74) *Attorney, Agent, or Firm* — Notaro, Michalos & Zaccaria P.C.

(57) ABSTRACT

To provide a slide hinge which can be easily attached to a door or a cabinet main body of honeycomb cardboard, on which attaching screws do not work well, and which is further devised to eliminate a risk of escape from the door after the fixation, fittings enabling a coupling case to be attached to the door even without attaching screws or nails are provided; furthermore, each of the fittings comprises an attaching case part integrally connected to each side portion of the coupling case, and an fitting for each attaching case part; then, this fitting comprises a locking plate housed into the attaching case part and a diameter expanding means pushing out craw portions of the locking plate; the diameter expanding means further comprises an operating plate with pressurizing portions protruding on an outer circumference and a cap locked by a locking plate on each attaching case part.

9 Claims, 30 Drawing Sheets

SLIDE HINGE

FIELD OF THE INVENTION

The invention relates to a slide hinge also referred to as a concealed hinge which is used for opening and closing a door in furniture such as cabinets intended for use in common households or offices.

BACKGROUND OF THE INVENTION

Some sorts of furniture, such as storage shed, large furniture, furnishing and storage box, are installed in common households, while other sorts are used in the office. For both categories of furniture, a cabinet is a representative item. The furniture as above described, and in particular cabinet, commonly uses a slide hinge structured as described in Japanese Laid-Open Patent Application No. 2003-90167 or Japanese Utility Model Registration No. 3090408. Namely, the publicly known slide hinge of this sort basically comprises a slide hinge main body attached to a cabinet main body so as to be adjustable relative to the latter in a slidable manner, a coupling case housed in an attaching hole provided on the door side and fixed into the hole using attaching screws, and a coupling piece coupling the coupling case to the hinge main body.

If a conventional slide hinge as above described includes a coupling case attached to a door of wooden solid material, attaching screws well fasten the coupling case onto the door, so that the door will not easily escape from the coupling case; in recent years however, a different type of doors is increasingly used, wherein the door comprises a core, e.g. honeycomb cardboard, on which attaching screws do not work well, and thin dressing boards stuck onto the both sides of the core.

Even if a user tries to fix a coupling case of a slide case onto a door with a core of honeycomb cardboard, on which screws do not work well, there has been a problem in that the coupling case cannot be firmly fixed onto the door or escapes from the door during usage after fixation.

SUMMARY OF THE INVENTION

To solve the above-mentioned problem, an object of the invention is to provide a slide hinge which can be easily attached to a door or a cabinet main body of honeycomb cardboard, on which attaching screws do not work well; the slide hinge according to the invention is further devised to eliminate a risk of escape from the door after the fixation.

According to a first aspect of the invention, this object is fulfilled by a slide hinge comprising a slide hinge main body attached to a cabinet main body, a coupling case inserted and fixed into an attaching hole provided on a door side, and coupling pieces coupling the coupling case to the hinge main body, so that the coupling case is openable and closable relative to the hinge main body. The slide hinge is characterized in that a pair of attaching means which can be attached to the door side even without using attaching screws are provided, that each attaching means comprises an attaching case member integrally connected to both side portions of the coupling case, a locking plate having craw portions provided so as to protrude outside from the attaching case member, wherein the locking plate is housed in the attaching case member, and a diameter expanding means pushing out the craw portions of the locking plate, so that the craw portions protrude outward, and that the diameter expanding means comprises an operating plate having a plurality of pressurizing portions rotatably housed in the locking plate and protruding from an outer circumference of the operating plate and a shaft portion having a tool mounting portion toward a tip on a central portion, wherein a rotation angle of the operating plate is controlled by a stopper means within a predetermined range, and a cap having a bearing hole for pivotally supporting the shaft portion on a central portion of the cap, wherein the cap is attached to the attaching case member so as to be attachable and detachable.

According to a second aspect of the invention, a stopper means of each of operating plates according to a first aspect of the invention can be made up of a stopper piece which is provided on the operating plate, wherein the stopper piece passes through both of a first guide hole provided on each of locking plates and a second guide hole so provided on each of attaching case members that the second guide hole overlaps the first guide hole.

According to a third aspect of the invention, a stopper means of each of operating plates according to a first aspect of the invention can be projections provided on pressurizing portions of an operating plate.

Furthermore, according to a fourth aspect of the invention, a slide hinge comprises a slide hinge main body attached to a cabinet main body, a coupling case inserted and fixed into an attaching hole provided on a door side, and coupling pieces coupling the coupling case to the hinge main body, so that the coupling case is openable and closable relative to the hinge main body. The slide hinge is characterized in that a pair of attaching means which can be attached to the door side even without using attaching screws are provided, that each of the attaching means comprises an attaching case member integrally connected to both side portions of the coupling case, craw portions provided so as to be swingable outward of the attaching case member, and a diameter expanding means pushing out the craw portions of the locking plate, so that the craw portions protrude outward, and that the diameter expanding means comprises an operating plate having a plurality of pressurizing portions rotatably housed in the locking plate and protruding from an outer circumference of the operating plate and a shaft portion having a tool mounting portion toward a tip on a central portion, wherein a rotation angle of the operating plate is controlled by a stopper means within a predetermined range, and a cap having a bearing hole for pivotally supporting the shaft portion on a central portion of the cap, wherein the cap is attached to the attaching case member so as to be attachable and detachable.

According to a fifth aspect of the invention, a slide hinge comprises a slide hinge main body attached to a cabinet main body, a coupling case inserted and fixed into an attaching hole provided on the door side, and coupling pieces coupling the coupling case to the hinge main body, so that the coupling case is openable and closable relative to the hinge main body. The slide hinge is characterized in that a pair of attaching means which can be attached to the door side even without using attaching screws are provided, that each of the attaching means comprises an attaching case member integrally connected to both side portions of the coupling case, a locking plate having craw portions provided so as to protrude outside from the attaching case member, wherein the locking plate is housed in the attaching case member, and a diameter expanding means pushing out the craw portions of the locking plate, so that the craw portions protrude outward, and that the diameter expanding means is made up of a cap press-fitted into the operating plate, so that the cap expands a diameter of the craw portions, wherein the cap is locked by the attaching case member.

According to a sixth aspect of the invention, a slide hinge comprising a slide hinge main body attached to a cabinet main body, a coupling case inserted and fixed into an attaching hole provided on a door side, and coupling pieces coupling the coupling case to the hinge main body, so that the coupling case is openable and closable relative to the hinge main body. The slide hinge is characterized in that a pair of attaching means which can be attached to the door side even without using attaching screws are provided, that each of the attaching means comprises an attaching case member integrally connected to both side portions of the coupling case, a plurality of craw portions provided so as to protrude outside from the attaching case member, each of the craw portions having a first pressure receiving portion and a second pressure receiving portion and a diameter expanding means pushing out the craw portions of the locking plate, so that the craw portions protrude outward, and that the diameter expanding means comprises an operating plate having a shaft portion, a tool mounting portion provided on the shaft portion, a plurality of first pressurizing portions protruding on an outer circumference of the shaft portion and a plurality of second pressurizing portions protruding on an outer circumference of the shaft portion, wherein the operating plate is rotatably housed into the attaching case member, a cap having a bearing hole for pivotally supporting the shaft portion of the operating plate and a guide groove for guiding the craw portions so that the craw portions are swingable, wherein the cap is locked by the attaching case member so as to be attachable and detachable.

According to a seventh aspect of the invention, a slide hinge comprising a slide hinge main body attached to a cabinet main body, a coupling case inserted and fixed into an attaching hole provided on a door side, and coupling pieces coupling the coupling case to the hinge main body, so that the coupling case is openable and closable relative to the hinge main body. The slide hinge is characterized in that a pair of attaching means which can be attached to the door side even without using attaching screws are provided, that each of the attaching means comprises an attaching case member integrally connected to both side portions of the coupling case, a locking plate having craw portions provided so as to protrude outside from the attaching case member, wherein the locking plate is pivotally supported by and housed into the attaching case member, and a diameter expanding means pushing out the craw portions of the locking plate, so that the craw portions protrude outward, and that the diameter expanding means comprises an operating plate having a plurality of pressurizing portions pivotally supported by and rotatably housed into the locking plate, the pressurizing portions protruding on an outer circumference of the locking plate, a tool mounting portion provided toward a tip on a central portion of the locking plate, wherein a rotation angle of the operating plate is controlled by a stopper means within a predetermined range, a cap having a bearing hole for pivotally supporting the tool mounting portion, wherein the cap is attached to the attaching case member so as to be attachable and detachable.

According to an eighth aspect of the invention, a slide hinge is characterized in that each of craw portions is so structured that they are housed in each of attaching case members in the normal state.

According to a ninth aspect of the invention, a slide hinge according to any of the above-mentioned aspects can be also realized with an attaching hole provided on the cabinet main body.

The invention is structured as in the foregoing. Therefore, according to a first aspect of the invention, when a coupling case (a component of a slide hinge) is inserted into an attaching hole provided on the door side, on which nails or attaching screws do not work well, a coupling case is inserted together with attaching means into the attaching hole and connecting holes provided on the attaching hole. At this point, tools such as a wrench are sequentially inserted into a tool mounting portion provided on each operating plate in order to rotate the operating plate, and then pressurizing portions rotating together with it push craw portions provided on locking pieces on each locking plate out of the corresponding attaching case member, so that the craw portions eat into a circumferential wall of connecting holes. Therefore, the coupling case can be firmly fixed into the attaching hole, with no risk of escape after the installation.

The layout as in a second aspect of the invention enables a stopper means of each operating plate to move from each start edge portion to each end edge portion, respectively of each second guide hole and each first guide hole, in accordance with a rotation of the operating plate, in order to stop the rotation. Therefore, the rotation of pressurizing portions can be arrested, whenever each craw portion of each locking piece eats into a circumferential wall to the degree as is necessary, so that an excessive rotation of the pressurizing portions can be prevented.

The layout as in a third aspect of the invention enables a projection provided on each pressurizing portion to abut against the corresponding engagement piece or craw portion and to stop the rotation. Thus the layout has an advantage that an excessive rotation of the pressurizing portions can be prevented and the structure of a stopper means is further simplified.

The layout as in a fourth aspect of the invention leads to a reduction in number of parts and a further simplification in layout as compared to that in a first aspect. Moreover, tools such as a wrench are sequentially inserted into a tool mounting portion provided on each operating plate in order to rotate the operating plate, and then pressurizing portions rotating together with it push craw portions provided on locking pieces on each locking plate out of the corresponding attaching case member, so that the craw portions eat into a circumferential wall of connecting holes. Therefore, the coupling case can be firmly fixed into the attaching hole, with no risk of escape after the installation.

The layout as in a fifth aspect of the invention allows for a reduction in number of parts and a further simplification in layout as compared to that in a first aspect. Moreover, after each attaching case member is fitted into a corresponding connecting hole, each cap is press-fitted into a corresponding locking plate, and thus the craw portions eat into a circumferential wall of connecting holes. Therefore, the coupling case can be firmly fixed into the attaching hole, with no risk of escape after the installation.

The layout as in a sixth aspect of the invention has the following results: if, after each attaching case member is fitted into a corresponding connecting hole, tools such as a wrench are inserted into a tool mounting portion of each operating plate in order to rotate the operating plate, pressurizing portions rotates together with it, and craw portions are pressurized outward of an attaching case member, in order to eat into a circumferential wall of connecting holes. Therefore, the coupling case can be firmly fixed into the attaching hole, with no risk of escape after the installation. Also as constructed as above described, the invention can achieve its object.

The layout as in a seventh aspect of the invention can have an advantage that in rotating an operating plate for diameter expansion of each craw portion of a locking plate, the operating plate rotates smoothly and an unequal diameter expansion of craw portions is prevented and the diameter expansion becomes stable.

The layout as in an eighth aspect of the invention can have an advantage that a coupling case and an attaching case member can be easily inserted into an attaching hole and connecting holes, and that craw portions which automatically go back to their original position can be easily removed.

The layout as in a ninth aspect of the invention has the following results: in any of the above-mentioned aspects of the invention, a board of cardboard honeycomb core, with thin dressing boards being stuck onto the both sides of the core is also suitable when used on a cabinet main body. A coupling case of a slide hinge is also applicable to such a board used on the cabinet main body.

EMBODIMENTS

In the following, the best modes for implementing the invention are described based on the accompanying drawings. The best modes for implementing the invention is characterized in that attaching means are provided on a coupling case to which a coupling piece is so attached that the coupling case can be fixed to a door or a cabinet main body without using attaching screws. In the following, reference is made to a coupling case attached to the door, but needless to say, the invention is also applicable to a coupling case attached to the cabinet main body. Normally two slide hinges of this sort are used upward and downward on a single door, but reference is made to a single slide hinge in the following.

Embodiment 1

Figure 1:
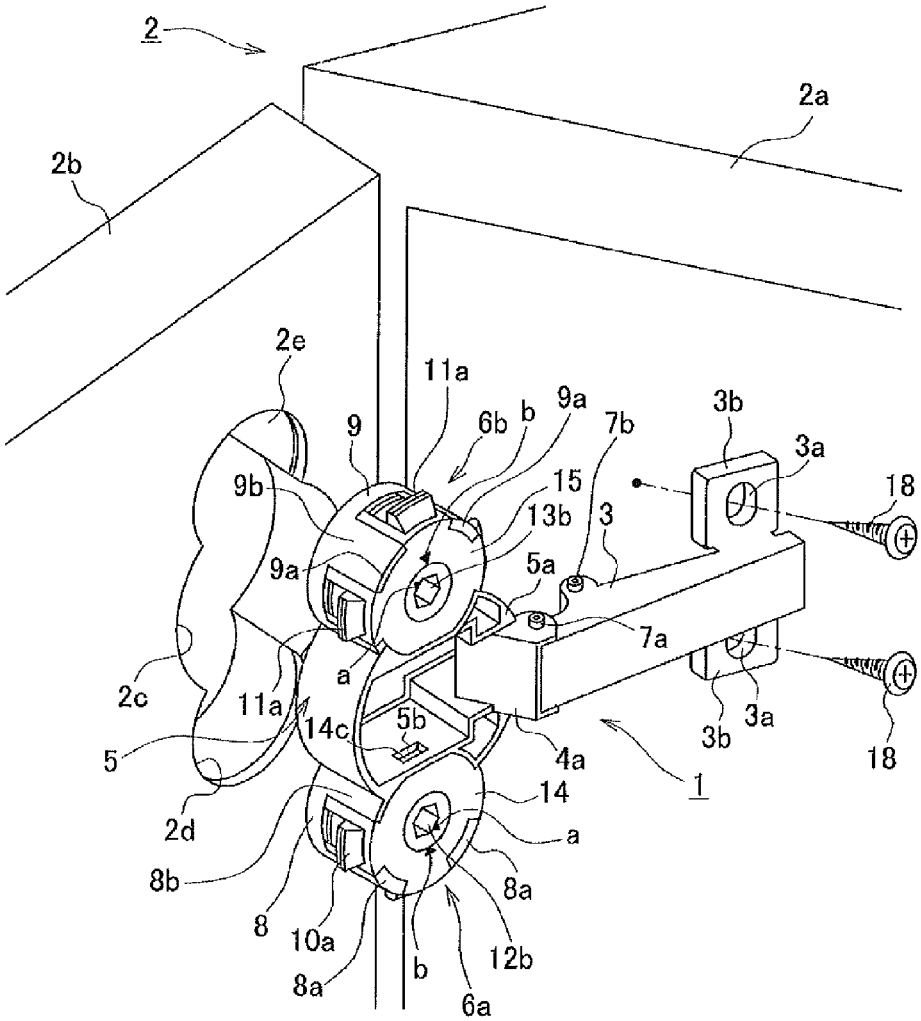
FIG. 1 is an explanatory view showing a state before installation of a slide hinge according to Embodiment 1 of the invention onto a cabinet.

In FIG. 1, a slide hinge 1 according to the invention comprises a slide hinge main body 3 attached to a cabinet main body 2*a* of a cabinet 2, a pair of coupling pieces, namely a first coupling piece 4*a* and a second coupling piece 4*b* comprising respectively one end portions each of which is rotatably coupled to the slide hinge main body 3, a coupling case 5 inserted and fixed into an attaching hole 2*c* provided on a door 2*b*, wherein respective other end portions of the first coupling piece 4*a* and the second coupling piece 4*b* are rotatably coupled to the coupling case as well, attaching means 6*a*, 6*b* for the coupling case 5, the attaching means being connected with the coupling case 5. Connecting holes 2*d*, 2*e* are provided on the door 2*b*, the connecting holes connecting the attaching means 6*a*, 6*b* with the attaching hole 2*c* for the coupling case 5, so as to insert and fix the former into the latter.

Figure 2:
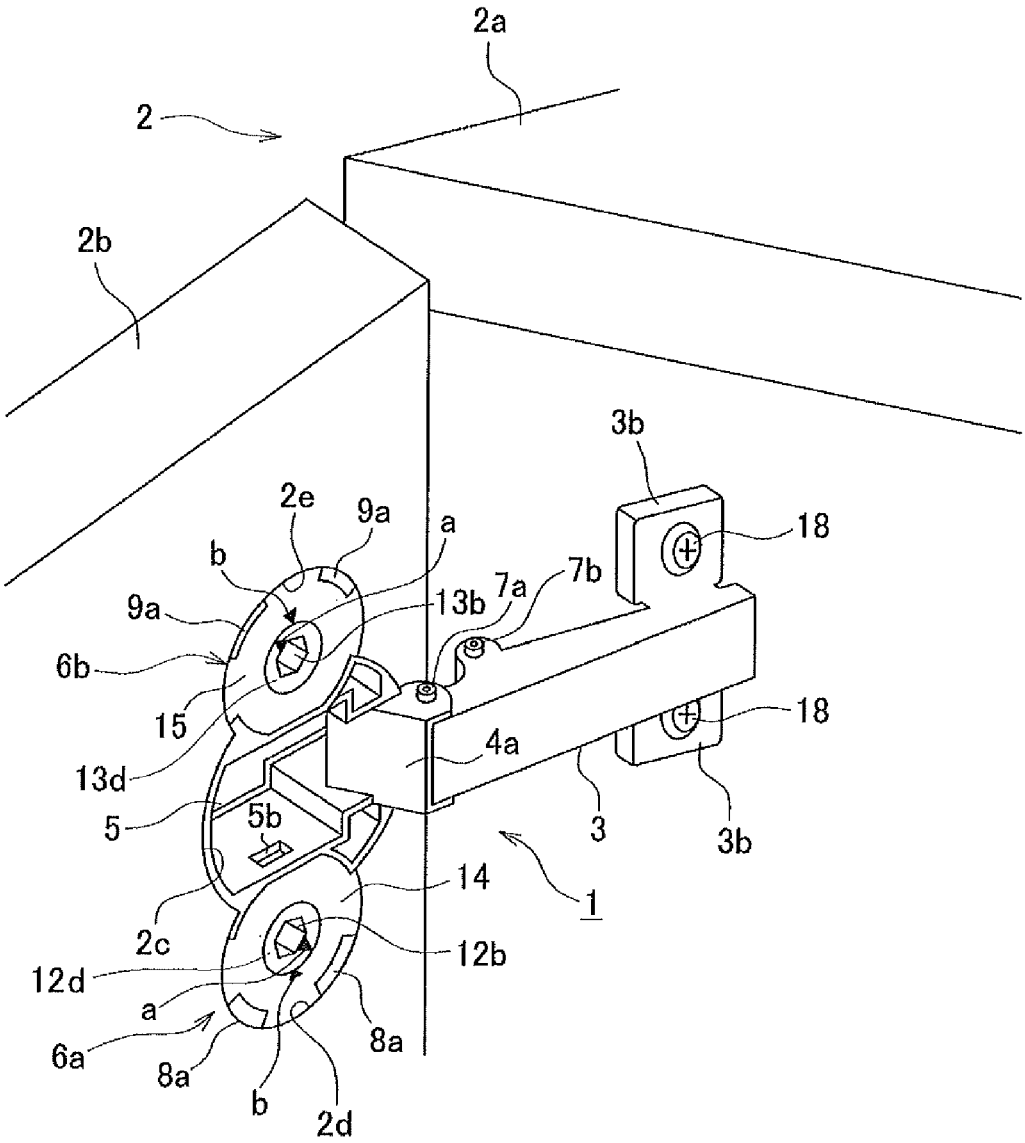
FIG. 2 is an explanatory view showing an attached state of a slide hinge as shown in FIG. 1 onto a cabinet.
Figure 3:
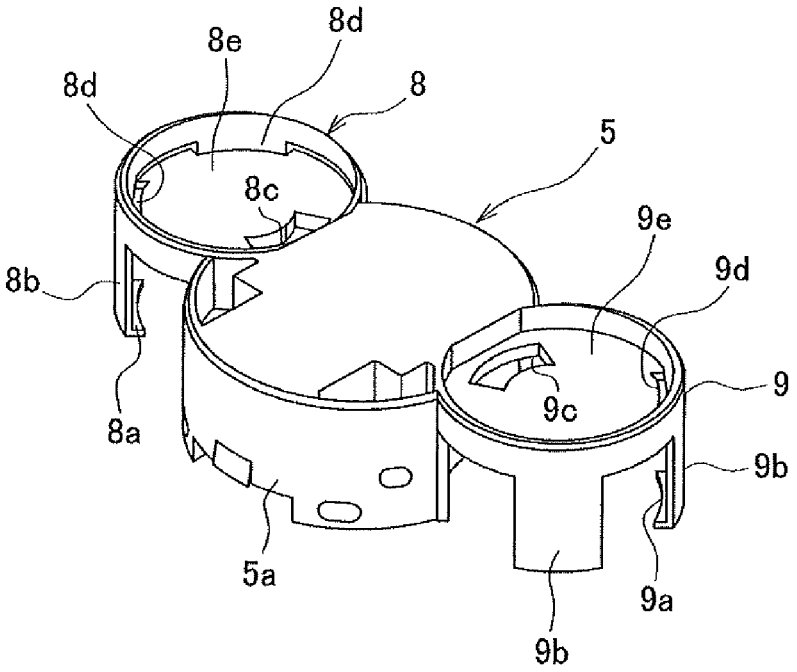
FIG. 3 is a perspective view of a portion corresponding to a coupling case and attaching means of a slide hinge as shown in FIG. 1, which is seen from the rear side.
Figure 4:
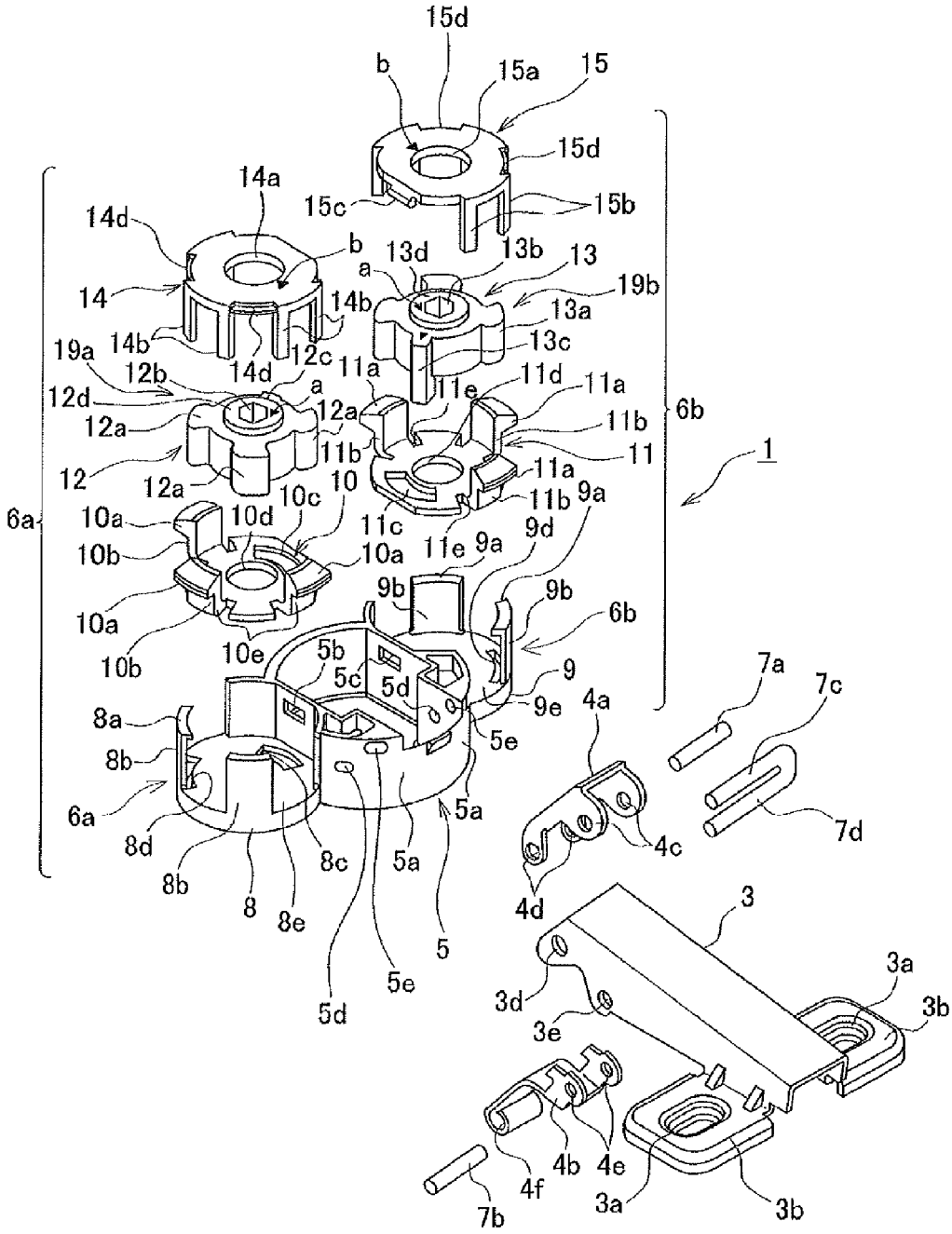
FIG. 4 is an exploded perspective view of a slide hinge as shown in FIG. 1.
Figure 5:
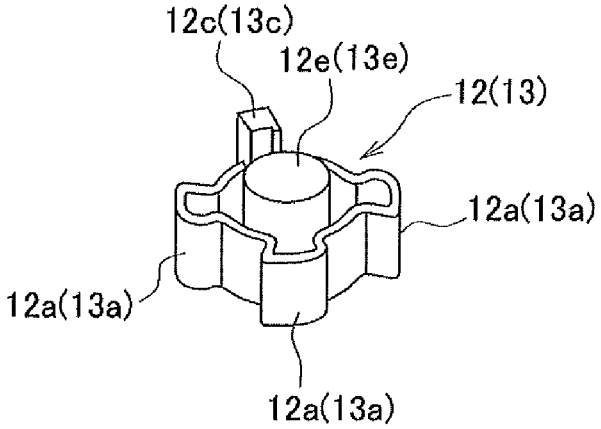
FIG. 5 is a perspective view showing only one of operating plates of a slide hinge according to the invention, which is seen from the bottom side.
Figure 6:
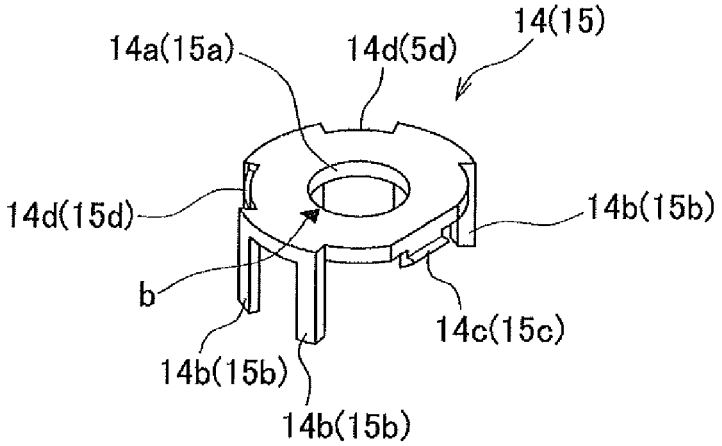
FIG. 6 is a perspective view showing only one of caps of a slide hinge according to the invention.

FIG. 2 shows a slide hinge 1 according to the invention as attached to a cabinet 2. As shown in the drawings, a slide hinge main body 3 is attached to a cabinet main body 2*a* via attaching screws 18, 18. On the other hand, a coupling case 5 and attaching means 6*a*, 6*b* connected with the coupling case 5 are inserted and fixed into an attaching hole 2*c* provided on a door 2*b* and connecting holes 2*d*, 2*e* connected with the attaching hole 2*c*.

Figure 7:
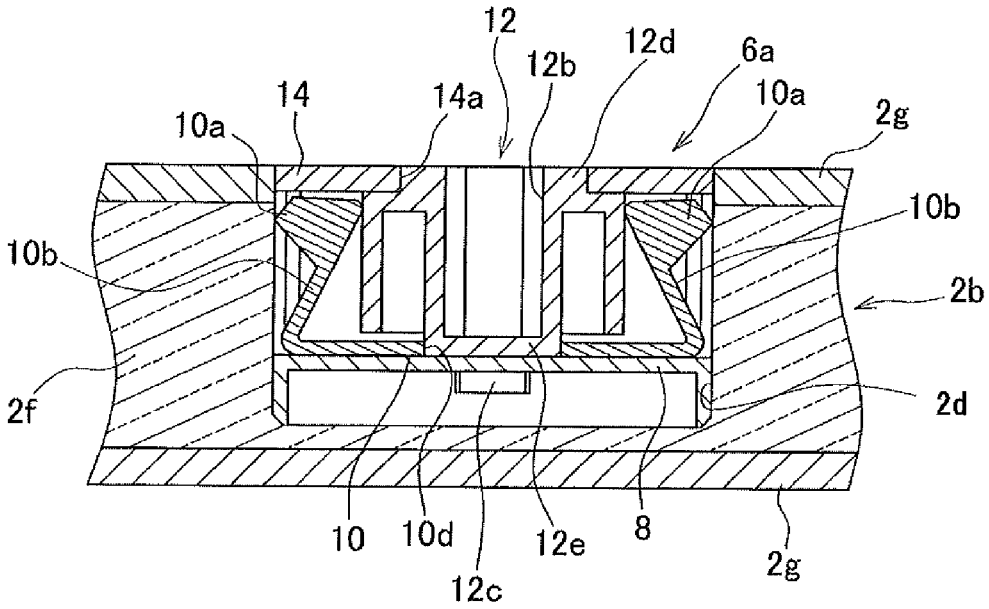
FIG. 7 is a sectional view showing a portion corresponding to attaching means of a slide hinge as shown in FIG. 1, as a coupling case inserted into an attaching hole.
Figure 8:
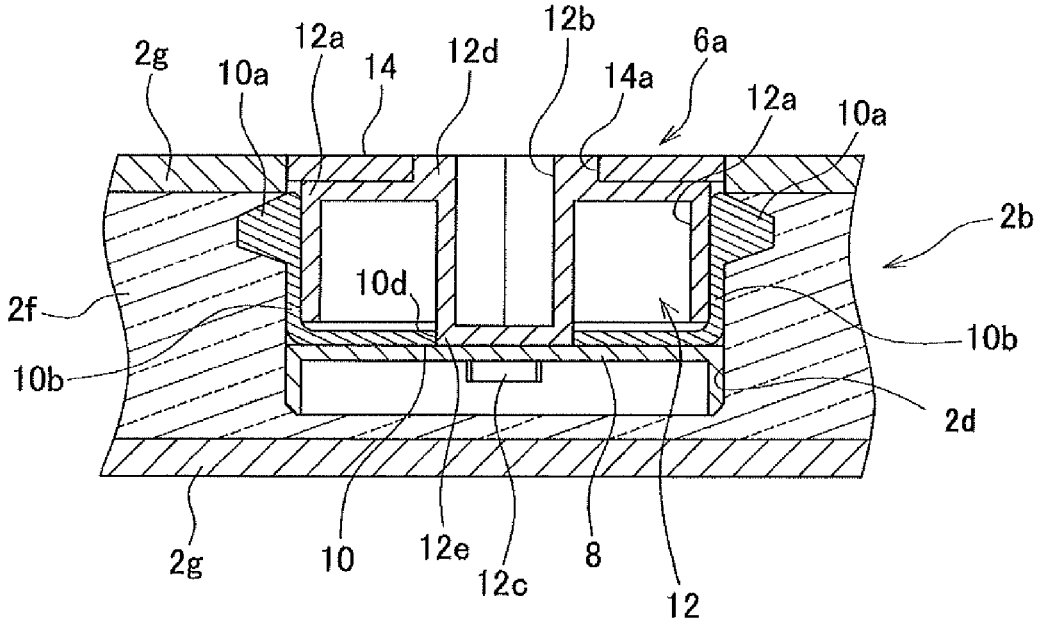
FIG. 8 is a sectional view showing a portion corresponding to attaching means of a slide hinge as shown in FIG. 1, as a coupling case inserted and fixed into an attaching hole.
Figure 9:
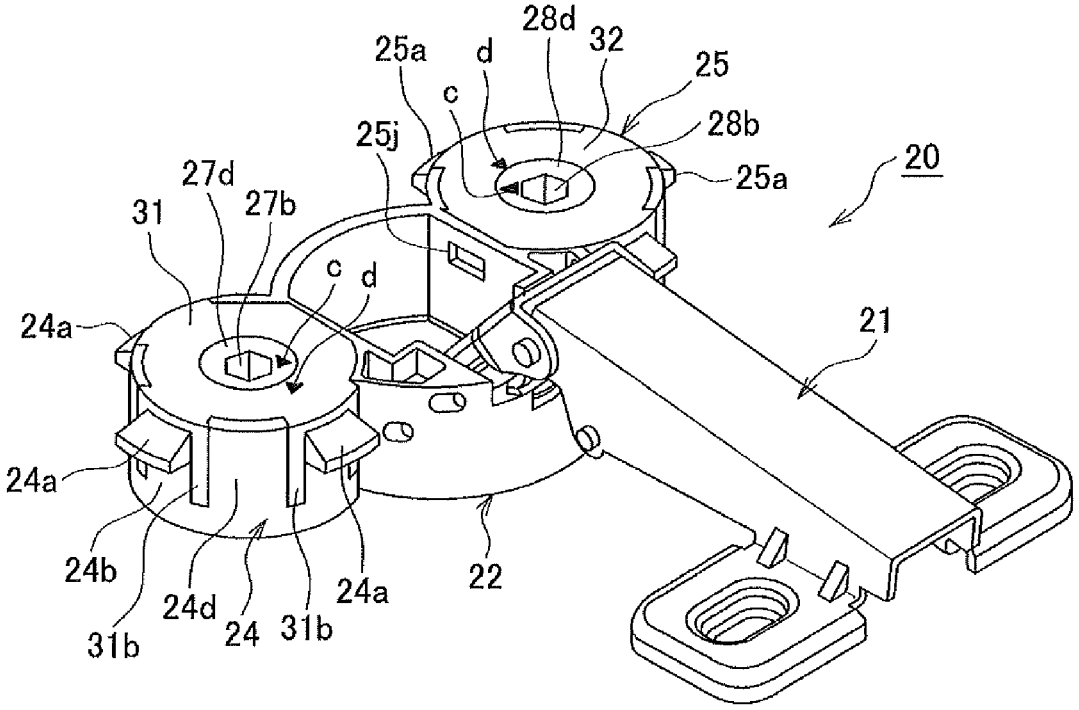
FIG. 9 is a perspective view showing other Embodiment 2 of a slide hinge according to the invention.
Figure 10:
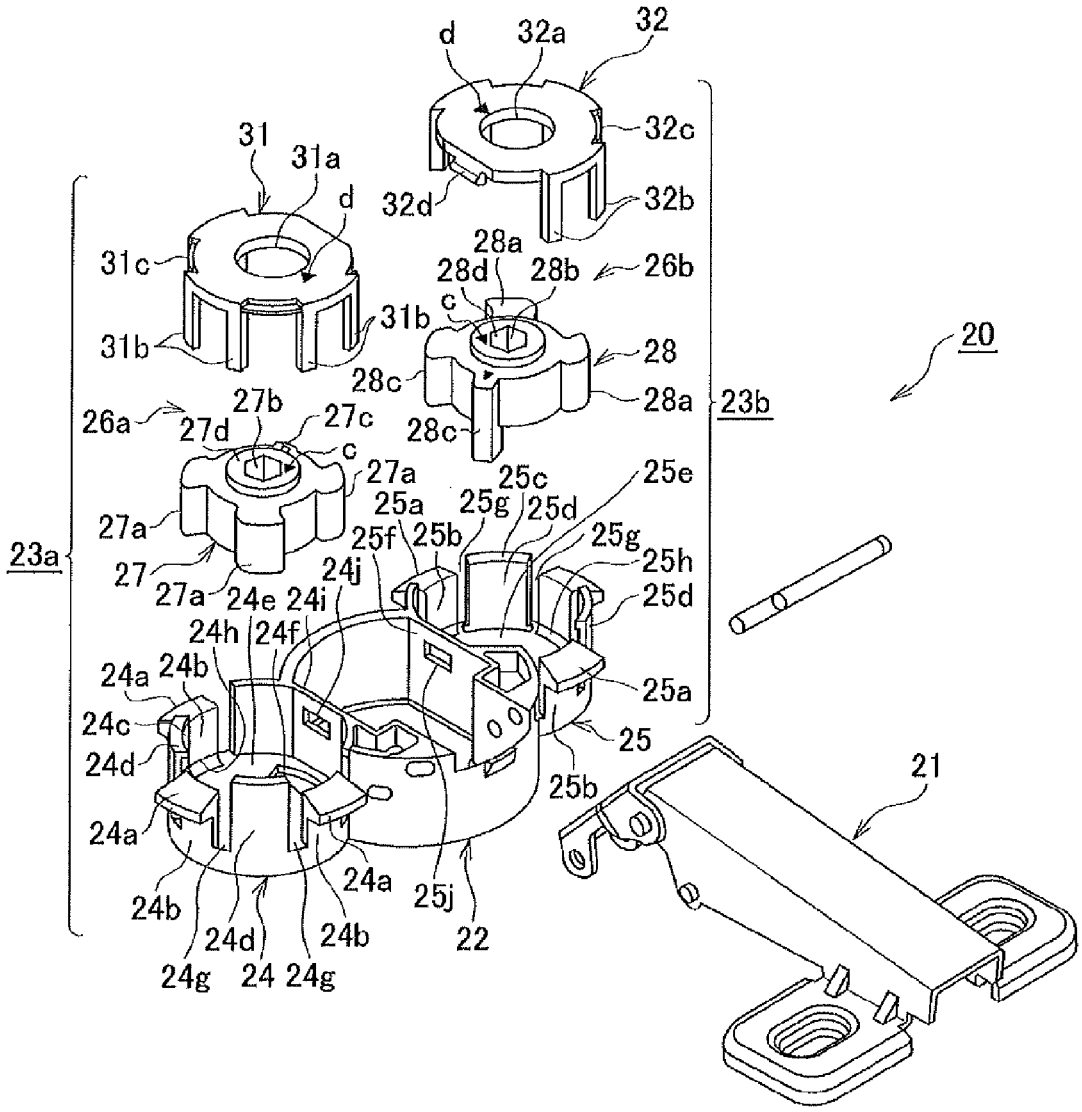
FIG. 10 is an exploded perspective view of a slide hinge as shown in FIG. 9.
Figure 11:
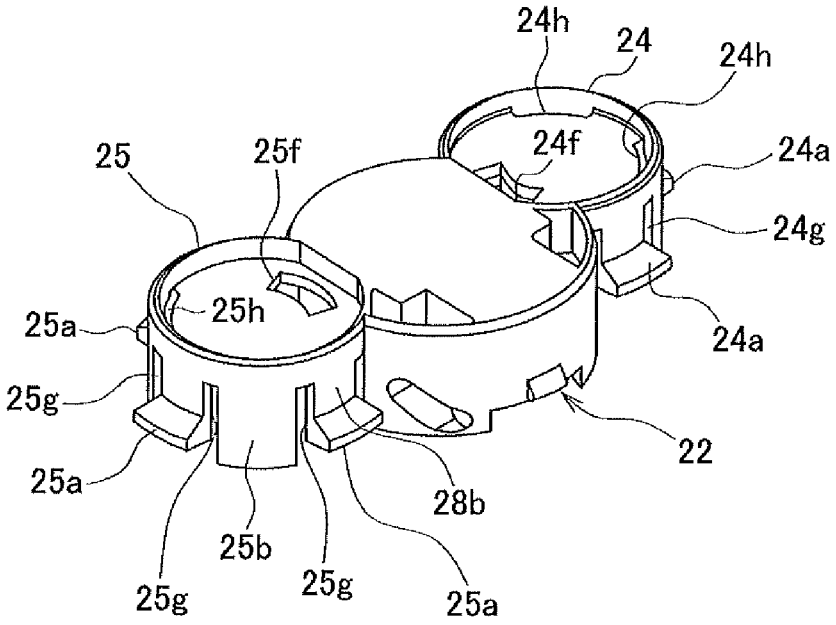
FIG. 11 is a perspective view of a portion corresponding to a coupling case and an attaching case member of a slide hinge as shown in FIG. 9, which is seen from the rear side.
Figure 12:
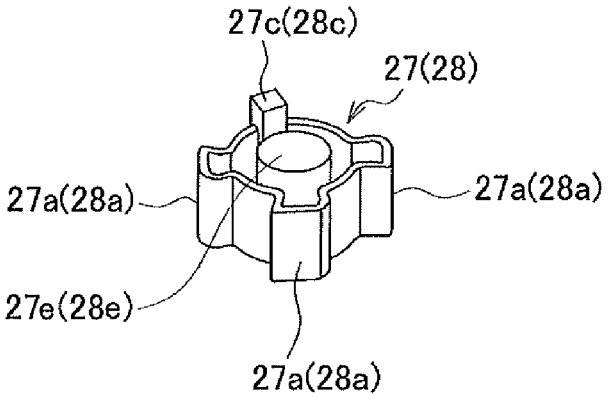
FIG. 12 is a perspective view of an operating plate of a slide hinge as shown in FIG. 9, which is seen from the rear side.
Figure 13:
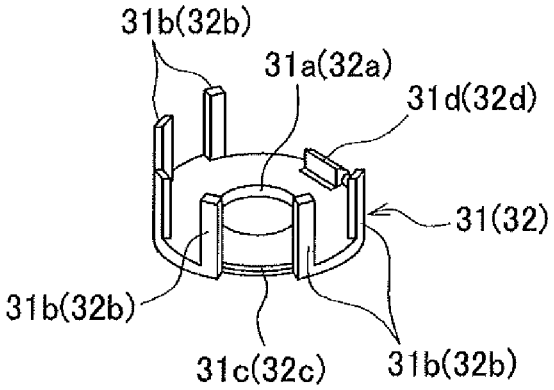
FIG. 13 is a perspective view of a cap of a slide hinge as shown in FIG. 9, which is seen from the rear side.
Figure 14:
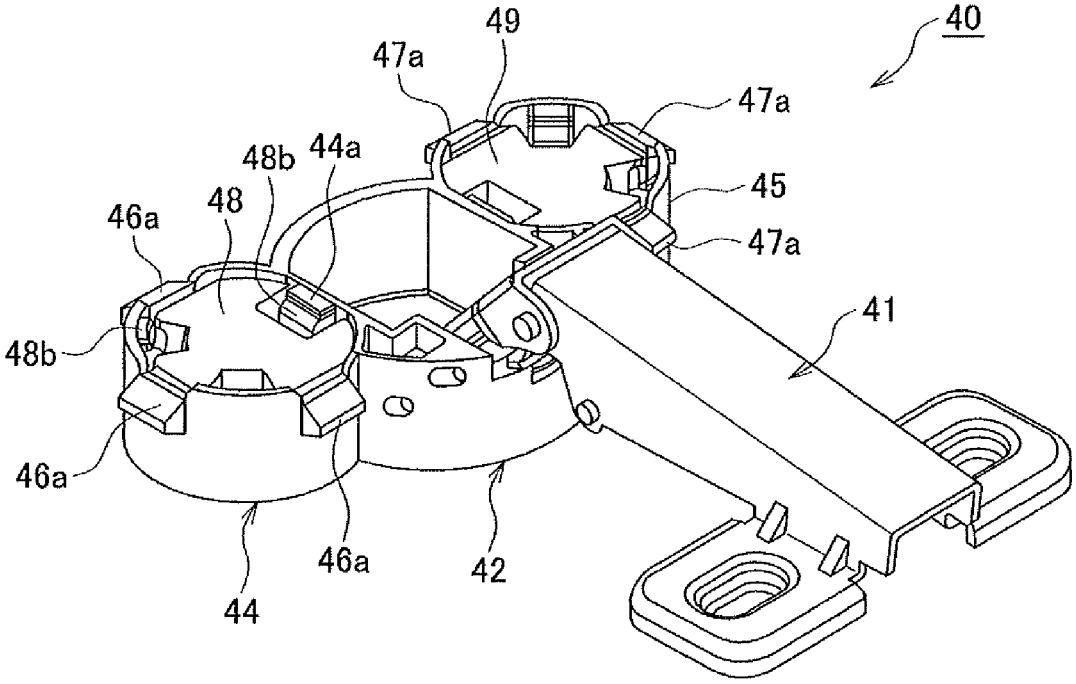
FIG. 14 is a perspective view showing further Embodiment 3 of a slide hinge according to the invention.
Figure 15:
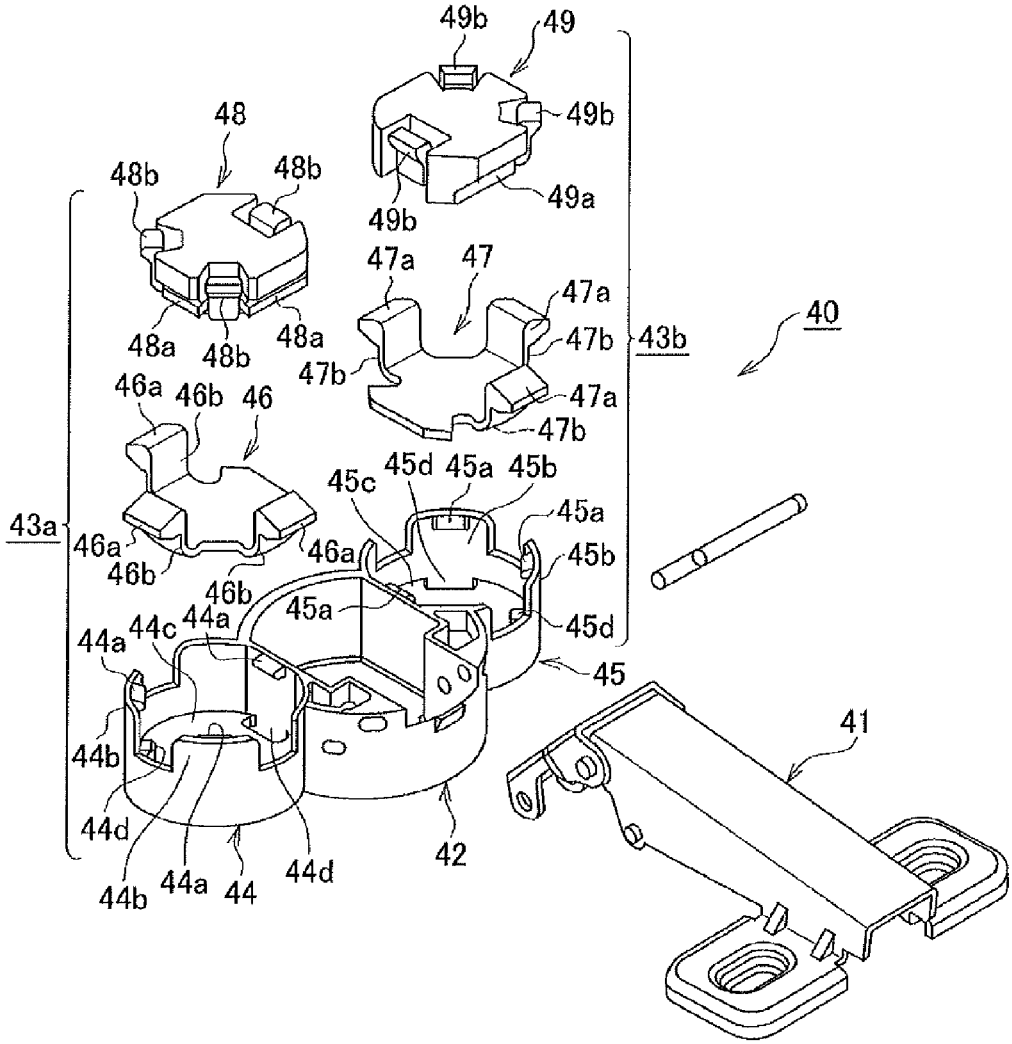
FIG. 15 is an exploded perspective view of a slide hinge as shown in FIG. 14.
Figure 16:
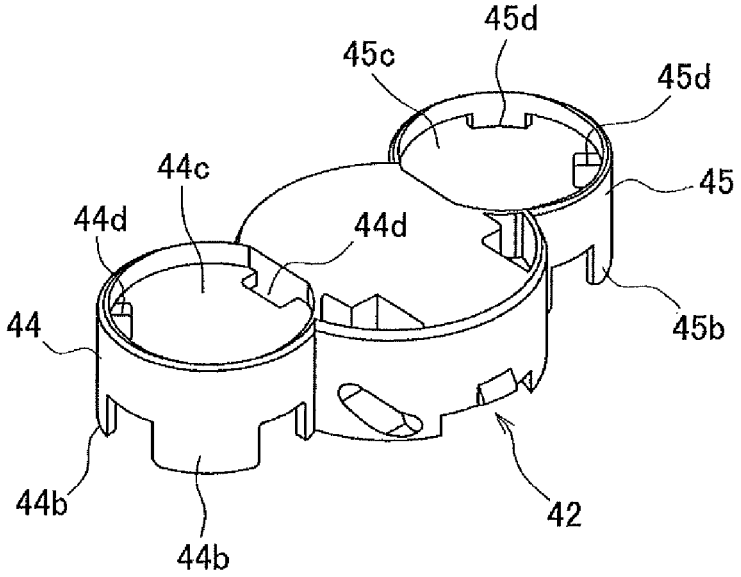
FIG. 16 is a perspective view of a portion corresponding to a coupling case and an attaching case member of a slide hinge as shown in FIG. 14, which is seen from the rear side.
Figure 17:
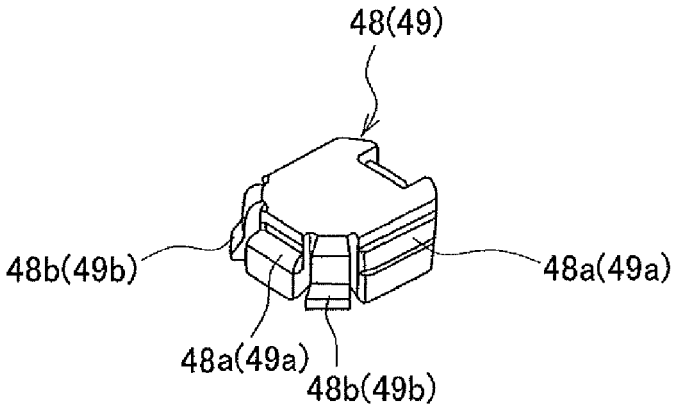
FIG. 17 is a perspective view of a cap of a slide hinge as shown in FIG. 14, which is seen from the rear side.
Figure 18:
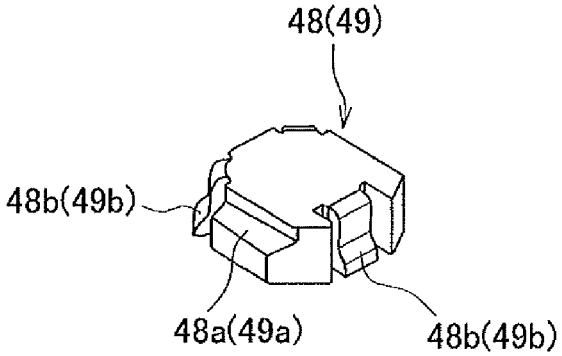
FIG. 18 is a perspective view of a cap of a slide hinge as shown in FIG. 14, which is seen from a different viewpoint on the rear side.
Figure 19:
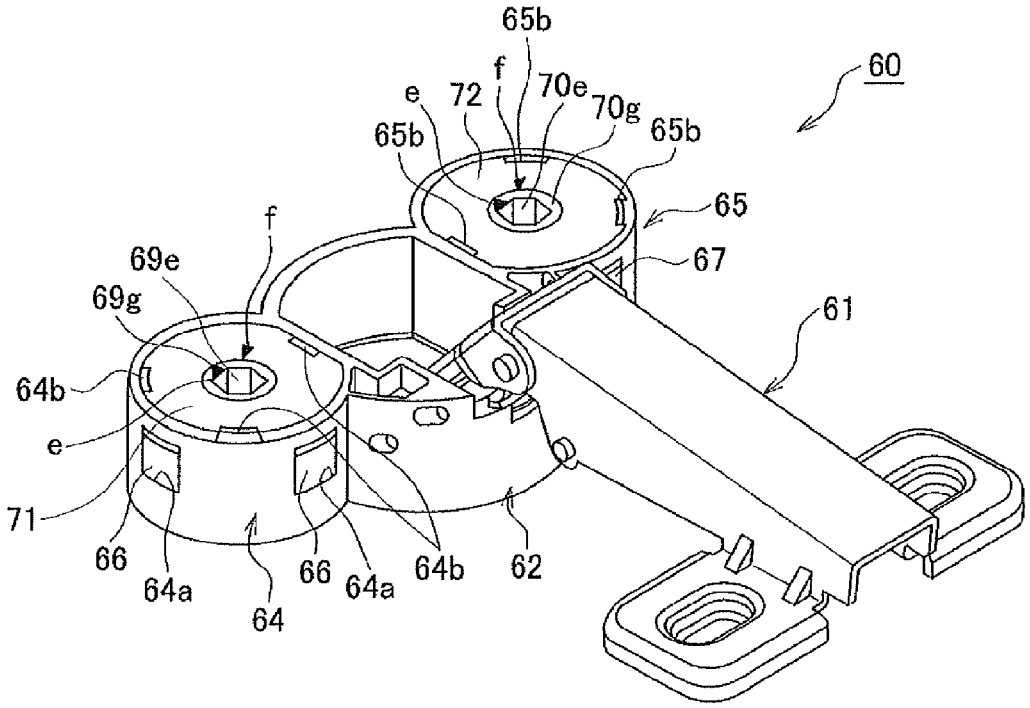
FIG. 19 is a perspective view showing further Embodiment 4 of a slide hinge according to the invention.

As shown in FIGS. 7 and 8, a door 2*b* according to the embodiments is made up by sticking thin dressing boards 2*g*, 2*g* onto the both sides of a honeycomb cardboard core 2*f*. However, a door 2*b* is not particularly limited thereto, and the invention is also applicable to a door made up of a material on which nails or attaching screws do not work.

As is evident from the drawings, a slide hinge main body 3, a first coupling piece 4*a* and a second coupling piece 4*b*, as well as a coupling case 5 of a slide hinge 1 according to the invention are not particularly limited in structure, but these elements may be structured following various known methods. In the meantime, a slide hinge main body 3 is a metal pressed part or molded part of synthetic resin, being in any case an elongated part having a U-shaped cross section. Attaching pieces 3*b*, 3*b* are provided so as to protrude from upper and lower portions on one end portion side.

A first coupling piece 4*a* and a second coupling piece 4*b*, both made in metal, are respectively coupled to coupling holes 3*d*, 3*e* provided on end portions on a side opposite to that with attaching pieces 3*a*, 3*b*, so as to be rotatable, by inserting a first hinge pin 7*a* and a second hinge pin 7*b* into coupling holes 4*c*, 4*e* provided on respective other end portions of the first coupling piece 4*a* and the second coupling piece 4*b*.

A coupling case 5 is a molded part of synthetic resin substantially in the cup-like shape. A first coupling piece 4*a* and a second coupling piece 4*b* are rotatably coupled to coupling holes 5*d*, 5*e* provided on a coupling portion 5*a* having a greater thickness on an edge of the coupling case, by inserting a third hinge pin 7*c* and a fourth hinge pin 7*d* (both hinge pins in the shape of two long bars of the letter U made up by bending a single bar-like material) into coupling holes 4*d*, 4*f* provided on respective other end portions of the first coupling piece 4*a* and the second coupling piece 4*b*.

Attaching means 6*a*, 6*b* for a coupling case 5 having an identical structure are integrally connected with both sides of the coupling case 5 and both made up of synthetic resin, being the same material as the coupling case 5. The attaching means 6*a* (6*b*) comprises an attaching case member 8 (9) provided with a plurality of locking pieces 8*b* (9*b*) erected from the edge of the attaching case member 8 (9) as spaced apart from each other at predetermined intervals, wherein each of the locking pieces 8*b* (9*b*) has a locking portion 8*a* (9*a*) provided on the tip of each of the locking pieces 8*b* (9*b*), a locking plate 10 (11) having locking pieces 10*b* (11*b*) with craw portions 10*a* (11*a*) in a disc-like shape erected as spaced apart from each other at predetermined intervals, wherein the locking plate 10 (11) is housed into the attaching case member 8 (9), with the craw portions 10*a* (11*a*) protruding outside from a space between the locking pieces 8*b* (9*b*), and a diameter expanding means 19*a* (19*b*) pushing the craw portions 10*a* (11*a*) out of the attaching case member 8 (9). The diameter expanding means 19*a* (19*b*) comprises an operating plate 12 (13) rotatably housed into the locking plate 10 (11), having a plurality of pressurizing portions 12*a* (13*a*) protruding from the outer circumference of the operating plate 12 (13) in a radial pattern and a stopper piece 12*c* (13*c*), wherein an insertion hole 12*b* (13*b*) for accommodating e.g. a wrench is provided above a tool mounting portion 12*d* (13*d*) provided on the central portion toward the upper portion side of the cap 14 (15), and the stopper piece 12*c* (13*c*) is inserted through a first guide hole 10*c* (11*c*) provided on each locking plate 10 (11) and a second guide hole 8*c* (9*c*) provided on each attaching case member 8 (9). The diameter expanding means 19*a* (19*b*) further comprises a cap 14 (15) substantially in a disc-like shape in a plan view, which is locked by a locking portion 8*a* (9*a*) of each attaching case member 8 (9), wherein the tool mounting portion 12*d* (13*d*) is exposed to the outside on the central portion of the cap 14 (15), the cap 14 (15) has a bearing hole 14*a* (15*a*) for bearing the upper side of a shaft portion 12*e* (13*e*), and a plurality of locking members 14*b* (15*b*) sandwich the corresponding locking pieces 10*b* (11*b*).

In the meantime, a notch 8*d* (9*d*) is provided on a base portion of a locking piece 8*b* (9*b*) on a bottom plate 8*e* (9*e*) of an attaching case member 8 (9), and a portion of the notch 8*d* (9*d*) forms an outer wall of a coupling case 5. Still further, a bearing hole 10*d* (11*d*) for housing a shaft portion 12*e* (13*e*) provided on a lower portion of an operating plate 12 (13) in the central portion of a locking plate 10 (11) is provided on the locking plate 10 (11). Moreover, notches 10*e* (11*e*) are provided on both sides of a base portion of locking pieces 10*b* (11*b*).

Furthermore, an engagement piece 14*c* (15*c*) is provided between locking members 14*b* (15*b*) on the edge of a cap 14 (15). The rotation of the cap 14 (15) is arrested by engaging the engagement piece 14*c* (15*c*) with an engagement hole 5*b* (5*c*) provided on a coupling case 5. Still further, triangle marks a, b are provided respectively in the vicinity of a tool mounting portion 12*d* (13*d*) of an operating plate 12 (13) and in the vicinity of a bearing hole 14*a* (15*a*) of the cap 14 (15). Still further, engagement concave portions 14*d* (15*d*) are provided on the edge of the cap 14 (15) and engaged with locking portions 8*a* (9*a*) provided on locking pieces 8*b* (9*b*) of an attaching case member 8 (9). An upper side and a lower side of a shaft portion 12*e* (13*e*) provided on an upper portion and a lower portion of each operating plate 12 (13) is fitted into a bearing hole 10*d* (11*d*) provided on a locking plate 10 (11) and a bearing hole 14*a* (15*a*) provided on the cap 14 (15), so that the operating plate 12 (13) assures a stable rotational movement with no shaft wobble during a rotation of the shaft portion 12*e* (13*e*).

Next, reference is made to an attaching procedure of the slide hinge 1 according to the invention into the cabinet 2, as shown in FIG. 1. First, the slide hinge main body 3 is attached to the cabinet main body 2*a*, using attaching screws 18, 18. Then, the coupling case 5 is inserted as it is into the attaching hole 2*c* provided on the door 2*b*, while the attaching means 6*a* (6*b*) into the connecting holes 2*d* (2*e*) provided on the door 2*b*, as each craw portion 10*a* (11*a*) of each locking plate 10 (11) is pushed entirely into the attaching means 6*a* (6*b*). The inserted state of the attaching means 6*a* into the connecting hole 2*d* implemented as above described is shown in FIG. 7. Its inserted state into the connecting hole 2*e* is implemented in the same manner.

Thereafter, with the tool such as wrench being mounted on the tool mounting portion 12*d* (13*d*) provided on the operating plate 12 (13) of the diameter expanding means 19*a* (19*b*), each operating plate 12 (13) is rotated to the point where the respective vertex points of the triangle mark a provided on the operating plate 12 (13) and of the triangle mark b provided on the cap 14 (15) meet each other, as shown in FIG. 2. Then, each pressurizing portion 12*a* (13*a*) pushes the craw portions 10*a* (11*a*) of the locking pieces 10*b* (11*b*) outward, so that the craw portions 10*a* (11*a*) of the locking pieces 10*b* (11*b*) eat into the circumferential wall of honeycomb structure of the connecting holes 2*d* (2*e*) of the door 2*b*, in order to fix the coupling case 5 into the door 2*b*, as shown in FIG. 8.

In the meantime, stopper means (not shown using reference numeral) are provided to prevent a rotation more than necessary, when an operating plate 12 (13) is rotated. Each stopper means comprises a stopper piece 12*c* (13*c*) provided on the operating plate 12 (13), a first guide hole 10*c* (11*c*) provided on each locking plate 10 (11) and a second guide hole 8*c* (9*c*) provided on each attaching case member 8 (9). When the stopper piece 12*c* (13*c*) moves from the start edge portion to the end edge portion, respectively of the second guide hole 8*c* (9*c*) and the first guide hole 10*c* (11*c*), and then stops, the pressurizing portion 12*a* (13*a*) forces the craw portions 10*a* (11*a*) to protrude to the outermost point, so that the craw portions eat into the circumferential wall of the connecting holes 2*d* (2*e*).

Still further, stopper means can be also constructed by providing a pressurizing portion 12*a* (13*a*) of an operating plate 12 (13) with projections (not shown) at the points where the operating plate 12 (13) abuts against the craw portions 10*a* (11*a*) after a rotation to a predetermined angle. If constructed as above described, the structure of the stopper means is further simplified, which allows for further cost reduction.

Embodiment 2

FIGS. 9 to 13 show another embodiment of a slide hinge according to the invention. In a slide hinge 20, a slide hinge main body 21 and a coupling case 22, as well as coupling means for both (a first and a second coupling pieces and respective hinge pins) according to Embodiment 2 as mentioned above are identical to those in Embodiment 1, therefore, reference numerals are omitted for some of them, and a detailed explanation is omitted for all of them.

Attaching means 23*a*, 23*b* for a coupling case 22 having an identical structure are integrally connected with both sides of the coupling case 22 and both made up of synthetic resin, being the same material as the coupling case 22. The attaching means 23*a* (23*b*) comprises an attaching case member 24 (25), wherein a plurality of locking pieces 24*b* (25*b*) erected from the edge of the attaching case member 24 (25) as spaced apart from each other at predetermined intervals via vertical groove portions 24*g* (25*g*), each of the locking pieces 24*b* (25*b*) having a craw portion 24*a* (25*a*) on the tip thereof, and a plurality of fixing pieces 24*d* (25*d*), each being provided with a locking portion 24*c* (25*c*) on the tip thereof, are so arranged that one comes after another, and a diameter expanding means 26*a* (26*b*) pushing the craw portions 24*a* (25*a*) outward. The diameter expanding means 26*a* (26*b*) comprises an operating plate 27 (28) rotatably housed into each attaching case member 24 (25), having a plurality of pressurizing portions 27*a* (28*a*) protruding from the outer circumference of the operating plate 27 (28) in a radial pattern and a stopper piece 27*c* (28*c*), wherein an insertion hole 27*b* (28*b*) for accommodating e.g. a wrench is provided above a tool mounting portion 27*d* (28*d*) provided on the central portion toward the top portion side of a shaft portion 27*e* (28*e*) of the operating plate 27 (28), and the stopper piece 27*c* (28*c*) is inserted through a guide hole 24*f* (25*f*) provided on a bottom plate 24*e* (25*e*) of each attaching case member 24 (25). The diameter expanding means 26*a* (26*b*) further comprises a cap 31 (32) substantially in a disc-like shape in a plan view, wherein the tool mounting portion 27*d* (28*d*) is exposed to the outside on the central portion of the cap 31 (32), the cap 31 (32) has a bearing hole 31*a* (32*a*) into which a shaft portion 27*e* (28*e*) is fitted, and engagement concave portions 31*c* (32*c*) provided between a plurality of hanging pieces 31*b* (32*b*) with the hanging pieces 31*b* (32*b*) being fitted between the vertical groove portions 24*g* (25*g*) are locked by the locking portion 24*c* (25*c*) of the attaching case member 24 (25). Moreover, notches 24*h* (25*h*) are provided on both sides of base portions of locking pieces 24*b* (25*b*) on a bottom plate 24*e* (25*e*) of the attaching case member 24 (25).

An engagement projecting piece 31*d* (32*d*) is provided on one end portion of the edge of a cap 31 (32). The rotation of the cap 31 (32) is arrested by engaging the engagement projecting piece 31*d* (32*d*) with an engagement hole 24*j* (25*j*) provided on a shared wall portion 24*i* (25*i*) for a coupling case 22 and each attaching case member 24 (25).

Still further, triangle marks c, d are provided respectively in the vicinity of a tool mounting portion 27*d* (28*d*) of an operating plate 27 (28) and in the vicinity of a bearing hole 31*a* (32*a*) of the cap 31 (32). A shaft portion 27*e* (28*e*) provided on an upper portion of each operating plate 27 (28) is fitted into a bearing hole 31*a* (32*a*) provided on the cap 31 (32), so that the operating plate 27 (28) assures a stable rotational movement with no shaft wobble during a rotation of the shaft portion 27*e* (28*e*).

Next, reference is made to an attaching procedure of the slide hinge 20 according to the invention into the cabinet. First, the slide hinge main body 21 is attached to the cabinet main body 2*a*, using attaching screws 18, 18, as shown in FIGS. 1 and 2 of Embodiment 1. Then, the coupling case 22 is inserted as it is into the attaching hole 2*c* provided on the door 2*b*, while the attaching means 23*a* (23*b*) into the connecting holes 2*d* (2*e*) provided on the door 2*b*, as each craw portion 24*a* (25*a*) of each locking piece 24*b* (25*b*) is pushed entirely into the attaching means 23*a* (23*b*).

Thereafter, with the tool such as wrench being mounted on the tool mounting portion 27*d* (28*d*) provided on the operating plate 27 (28), each operating plate 27 (28) is rotated to the point where the respective vertex points of the triangle mark c provided on the operating plate 27 (28) and of the triangle mark d provided on the cap 31 (32) meet each other, as shown in FIG. 2 of Embodiment 1. Then, each pressurizing portion 27*a* (28*a*) pushes the craw portions 24*a* (25*a*) of the locking pieces 24*b* (25*b*) outward, so that the craw portions 24*a* (25*a*) of the locking pieces 24*b* (25*b*) eat into the circumferential wall of honeycomb structure of the connecting holes of the door 2*b*, in order to fix the coupling case 22 into the door 2*b*, as in Embodiment 1, though not shown in this embodiment.

In the meantime, stopper means (not shown using reference numeral) are provided to prevent a rotation more than necessary, when an operating plate 27 (28) is rotated. Each stopper means comprises a stopper piece 27*c* (28*c*) provided on the operating plate 27 (28), and a guide hole 24*f* (25*f*) provided on each attaching case member 24 (25), wherein the stopper piece 27*c* (28*c*) is fitted into both of the guide holes. When the stopper piece 27*c* (28*c*) moves from the start edge portion to the end edge portion, of the guide hole 24*f* (25*f*), and then stops, the pressurizing portion 27*a* (28*a*) forces the craw portions 24*a* (25*a*) to protrude to the outermost point, so that the craw portions eat into the circumferential wall of the connecting holes (not shown in Embodiment 2, as described above).

Even if the invention is implemented as above described, the object of the invention is achieved, the structure is further simplified as compared to Embodiment 1.

Embodiment 3

FIGS. 14 to 18 show a further embodiment of a slide hinge according to the invention.

In a slide hinge 40, a slide hinge main body 41 and a coupling case 42, as well as coupling means for both (a first and a second coupling pieces and respective hinge pins) according to Embodiment 3 as mentioned above are identical to those in Embodiment 1, therefore, reference numerals are omitted for some of them, and a detailed explanation is omitted for all of them.

Attaching means 43*a*, 43*b* for a coupling case 42 having an identical structure are integrally connected with both sides of the coupling case 42 and both made up of synthetic resin, being the same material as the coupling case 42. The attaching means 43*a* (43*b*) comprises an attaching case member 44 (45) substantially in a cylindrical shape, wherein a plurality of fixing pieces 44*b* (45*b*) integrally connected with both sides of the coupling case 42 and erected from the edge of the attaching case member 44 (45) as spaced apart from each other at predetermined intervals, each of the fixing pieces 44*b* (45*b*) having a locking portion 44*a* (45*a*) on the tip thereof, and an operating plate 46 (47) in a disc-like shape in a plan view having a plurality of locking pieces 46*b* (47*b*), each of the locking pieces 46*b* (47*b*) comprising a craw portion 46*a* (47*a*) on the tip thereof, wherein the operating plate 46 (47) housed into the attaching case member 44 (45) with the craw portions 46*a* (47*a*) being pushed out, so that the craw portions 46*a* (47*a*) protrude from a space between the fixing pieces 44*b* (45*b*), and a cap 48 (49) being a diameter expanding means which pushes the craw portions 46*a* (47*a*) out, so that the latter protrude. The cap 48 (49) being a diameter expanding means is made up of a cap 48 (49) having pressurizing portions 48*a* (49*a*) so provided that each pressurizing portion 48*a* (49*a*) corresponds to each locking piece 46*b* (47*b*) of the operating plate 46 (47), wherein the cap 48 (49) is provided with a plurality of engagement portions 48*b* (49*b*) engaged with the locking portions 44*a* (45*a*) of the attaching case member 44 (45). In the meantime, notches 44*d* (45*d*) are provided on a bottom plate 44*c* (45*c*) of the attaching case member 44 (45), at points of base portions of the fixing pieces 44*b* (45*b*).

Next, reference is made to an attaching procedure of the slide hinge 40 according to the invention into the cabinet. First, the slide hinge main body 41 is attached to the cabinet main body 2*a*, using attaching screws 18, 18, as shown in FIGS. 1 and 2 of Embodiment 1. Then, the coupling case 42 is inserted as it is into the attaching hole 2*c* provided on the door 2*b*, while the attaching means 43*a* (43*b*) into the connecting holes 2*d* (2*e*) provided on the door 2*b*, as each craw portion 46*a* (47*a*) of the operating plate 46 (47) is pushed entirely into the attaching means 43*a* (43*b*), equally as shown in FIGS. 1 and 2 of Embodiment 1.

Thereafter, the engagement portions 48*b* (49*b*) of the cap 48 (49) are press-fitted into the operating plate 46 (47), with being aligned with the locking portions 44*a* (45*a*), to the point where each locking portion 44*a* (45*a*) is engaged with the corresponding engagement portion 48*b* (49*b*). Then, each pressurizing portion 48*a* (49*a*) of the cap 48 (49) being a diameter expanding means pushes the corresponding craw portion 46*a* (47*a*) of the locking pieces 46*b* (47*b*) outward, resulting in a greater diameter of the craw portions 46*a* (47*a*) in a plan view, so that each craw portion 46*a* (47*a*) of the locking pieces 46*b* (47*b*) eat into the circumferential wall of honeycomb structure of the connecting holes 2*d*, 2*e* of the door 2*b*, in order to firmly fix the coupling case 22 into the door 2*b*.

Even if the invention is implemented as above described, the object of the invention is achieved, the structure is further simplified as compared to Embodiment 1.

Embodiment 4

FIGS. 19 to 25A, 25B and 25C show a further embodiment of a slide hinge according to the invention. In a slide hinge 60, a slide hinge main body 61 and a coupling case 62, as well as coupling means for both (a first and a second coupling pieces and respective hinge pins) according to Embodiment 4 as mentioned above are identical to those in Embodiment 1, therefore, reference numerals are omitted for some of them, and a detailed explanation is omitted for all of them.

Attaching means 63*a*, 63*b* for a coupling case 62 having an identical structure are integrally connected with both sides of the coupling case 62 and both made up of synthetic resin, being the same material as the coupling case 62. The attaching means 63*a* (63*b*) comprises an attaching case member 64 (65) in a cylindrical shape in a plan view, each attaching case member having through holes 64*a* (65*a*) provided as spaced apart from each other at predetermined intervals on a outer circumference of the attaching case member and locking portions 64*b* (65*b*) provided as spaced apart from each other at predetermined intervals on an upper edge of the attaching case member, a plurality of craw portions 66 (67) slidably housed into the attaching case member 64 (65), so as to be advanced and retracted relative to the through holes 64*a* (65*a*) of the attaching case member 64 (65), and a diameter expanding means 68*a* (68*b*) pushing the craw portions 66 (67) out, so that the craw portions protrude. In the meantime, a first pressure receiving portion 66*a* (67*a*) inclined toward one side end portion of each craw portion 66 (67) is provided on each craw portion 66 (67), as well as stopper pieces 66*b* (67*b*) on both sides of each craw portion 66 (67) and a second pressure receiving portion 66*c* (67*c*) on one side portion toward a lower portion. In the meantime, an escape concave portion 66*d* (67*d*) for allowing for escape of tip part of a first pressurizing portion 69*d* (70*d*) is provided on the bottom surface of each craw portion 66 (67).

A diameter expanding means 68*a* (68*b*) comprises an operating plate 69 (70) having a disc portion 69*a* (70*a*) rotatably housed into each attaching case member 64 (65) and a shaft portion 69*b* (70*b*) protruding upward from a central portion of the disc portion 69*a* (70*a*), and a cap 71 (72) in a disc-like shape having a bearing hole 71*a* (72*a*) through which a tool mounting portion 69*g* (70*g*) is inserted, the cap further covering an upper portion of the attaching case member 64 (65). A stopper piece 69*c* (70*c*) fitted into a guide hole 64*d* (65*d*) provided on a bottom plate 64*c* (65*c*) of the attaching case member 64 (65) is provided on a lower surface of the operating plate 69 (70), while second pressurizing portions 69*f* (70*f*) and an insertion hole 69*e* (70*e*) provided on the tool mounting portion 69*g* (70*g*) for accommodating tool such as wrench is provided on the upper surface of the bottom plate 64*c* (65*c*). The bearing hole 71*a* (72*a*) for bearing the tool mounting portion 69*g* (70*g*) provided on a top portion of the shaft portion 69*b* (70*b*) of the operating plate 69 (70) is provided on a central portion of the cap 71 (72), engagement concave portions 71*b* (72*b*) are provided as spaced apart from each other at predetermined intervals on an edge portion of the cap 71 (72), and guide grooves 71*c* (72*c*) are so provided on a lower surface of the cap 71 (72) that each of the guide grooves corresponds to each of the craw portions 66 (67). Still further, once the attaching case member 64 (65) is covered with the cap 71 (72), the engagement concave portions 71*b* (72*b*) are engaged with locking portions 64*b* (65*b*) of the attaching case member 64 (65), and the craw portions 66 (67) are guided by the guide grooves 71*c* (72*c*) so as to slidable outward. Still further, a first pressure receiving portion 66*a* (67*a*) is provided in the area in which the craw portions 66 (67) abut against a first pressurizing portion 69*d* (70*d*), while a stopper piece 66*b* (67*b*) is provided on one side portion of the craw portions 66 (67).

Figure 25A:
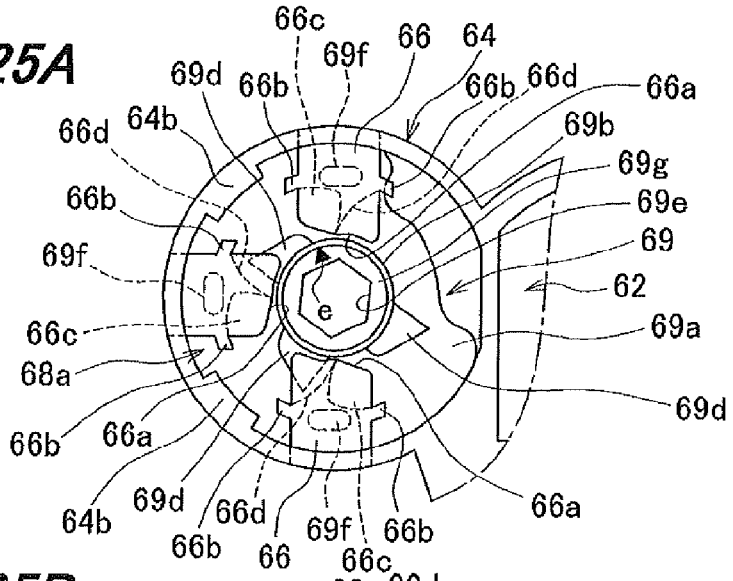
FIG. 25A is an explanatory view showing an operation of a diameter expanding means as shown in FIG. 19, in a state before the operation thereof.
Figure 25B:
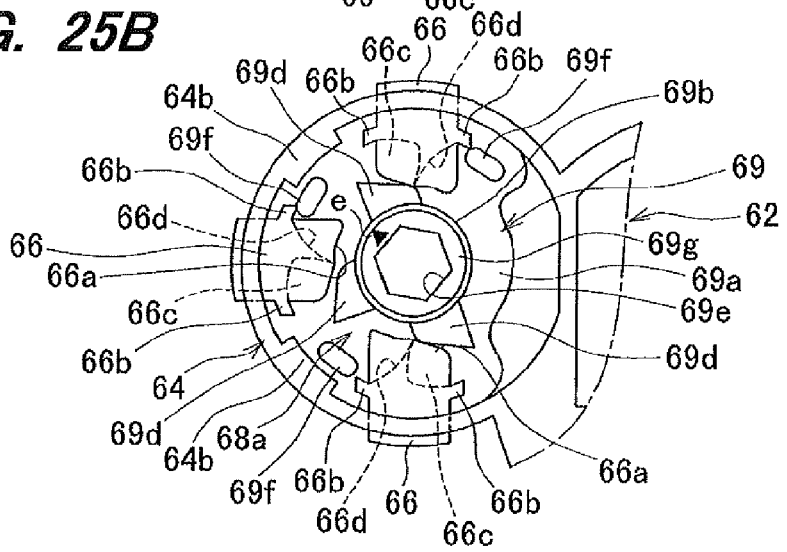
FIG. 25B is an explanatory view showing an operation of a diameter expanding means as shown in FIG. 19, in a state during the operation thereof.
Figure 25C:
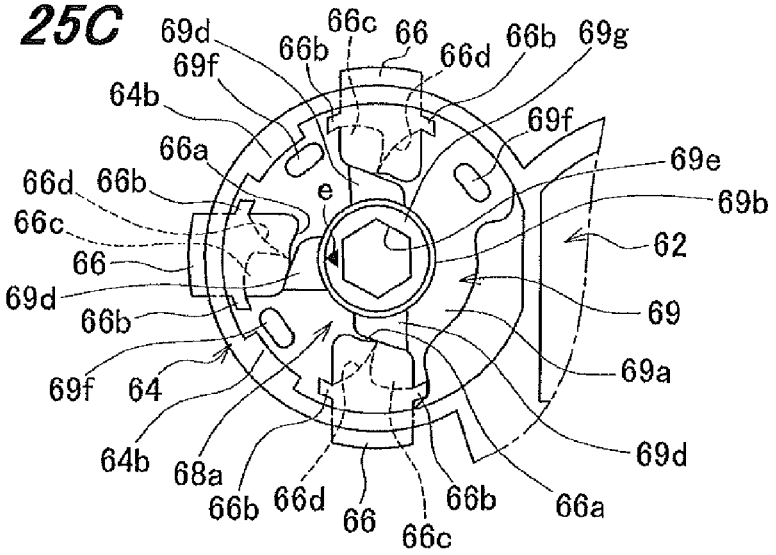
FIG. 25C is an explanatory view showing an operation of a diameter expanding means as shown in FIG. 19, in a state after completion of the operation thereof.
Figure 26:
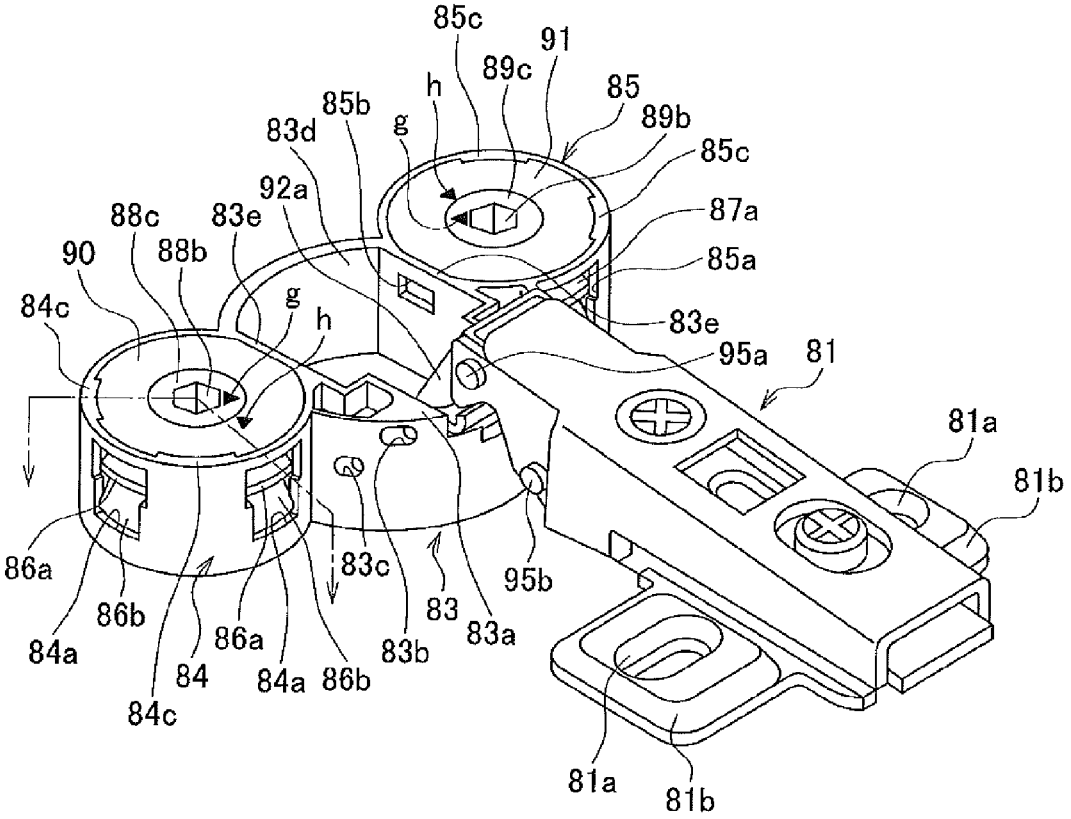
FIG. 26 is a perspective view showing Embodiment 5 of a slide hinge according to the invention.

Next, reference is made to an attaching procedure of the slide hinge 60 according to the invention into the cabinet. First, the slide hinge main body 61 is attached to the cabinet main body 2*a*, using attaching screws 18, 18, as shown in FIGS. 1 and 2 of Embodiment 1. Then, the coupling case 62 is fitted into the attaching hole 2*c* provided on the door 2*b*, while the attaching means 63*a* (63*b*) into the connecting holes 2*d* (2*e*) provided on the door 2*b*. At this point, the craw portions 66 is pushed by the second pressurizing portions 69*f* and retracted into the attaching case member 64. In the meantime, FIGS. 25A to 25C show only one diameter expanding means 68*a* of the diameter expanding means 68*a*, 68*b*, however, other diameter expanding means 68*b* is equally operated in the same manner. Therefore, reference is also made to other diameter expanding means 68*b* in reference to FIGS. 25A to 25C, using further reference numerals as are necessary. Accordingly, as is also evident from FIG. 19, the craw portions 67 is pushed by the second pressurizing portions 70*f* and retracted into the attaching case member 65, as shown in FIG. 25A, with reference to one diameter expanding means 68*a*.

Figure 20:
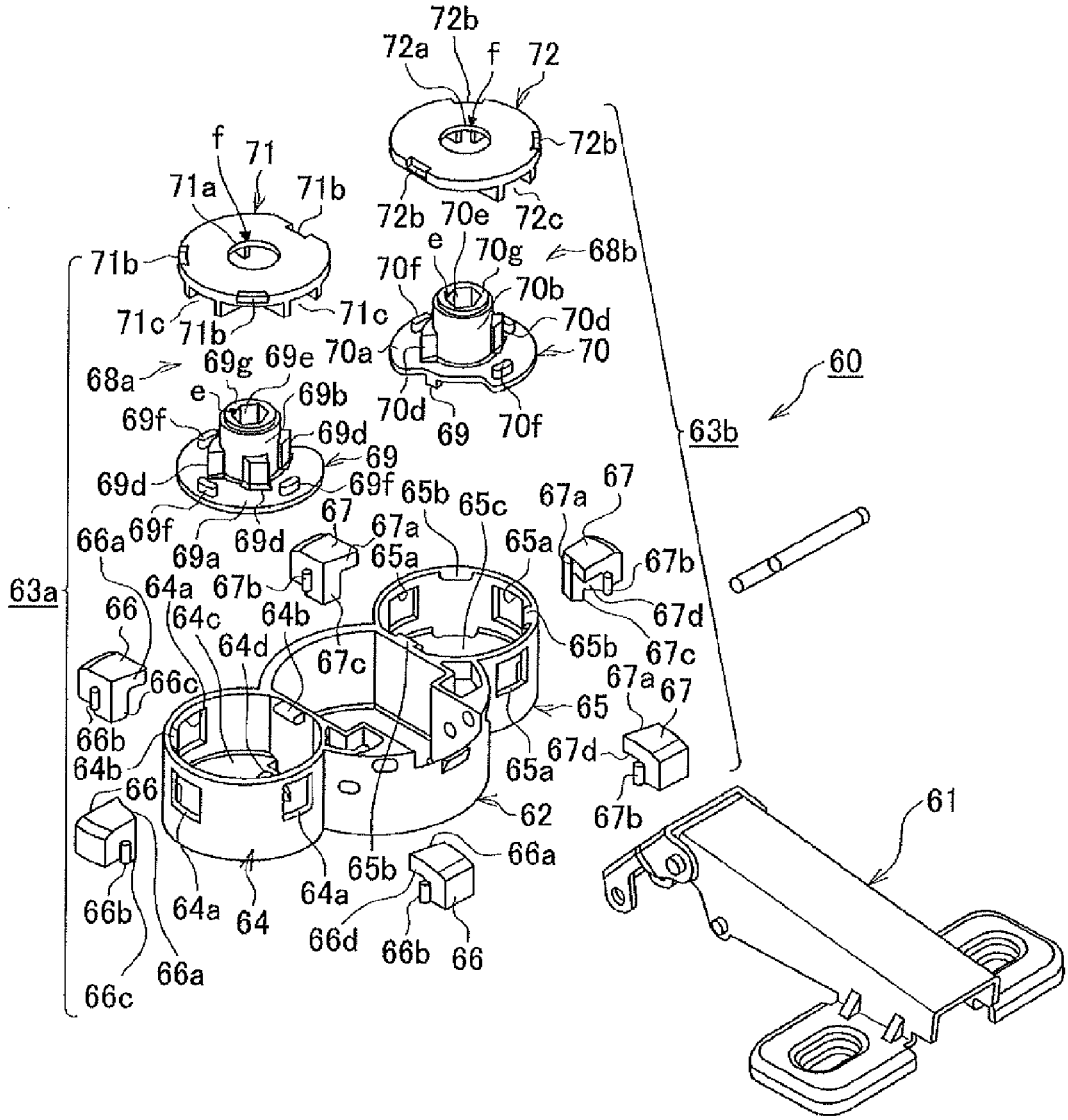
FIG. 20 is an exploded perspective view of a slide hinge as shown in FIG. 19.
Figure 21:
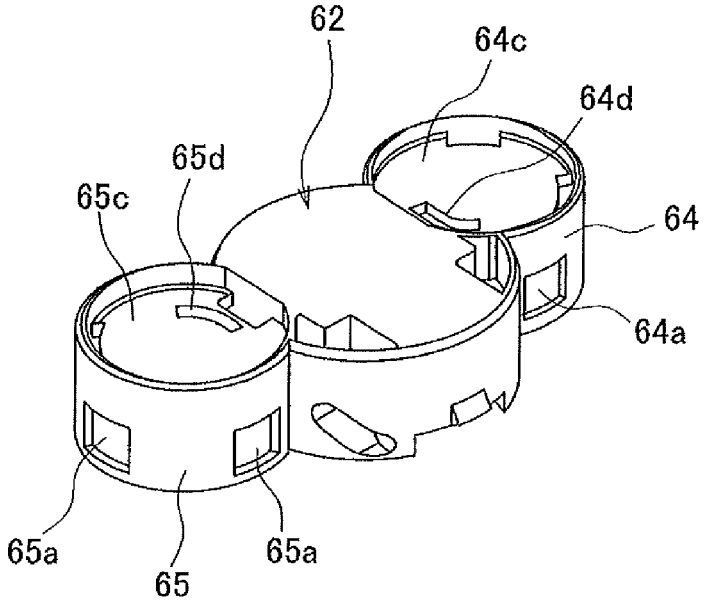
FIG. 21 is a perspective view of a portion corresponding to a coupling case and an attaching case member of a slide hinge as shown in FIG. 19, which is seen from the rear side.
Figure 22:
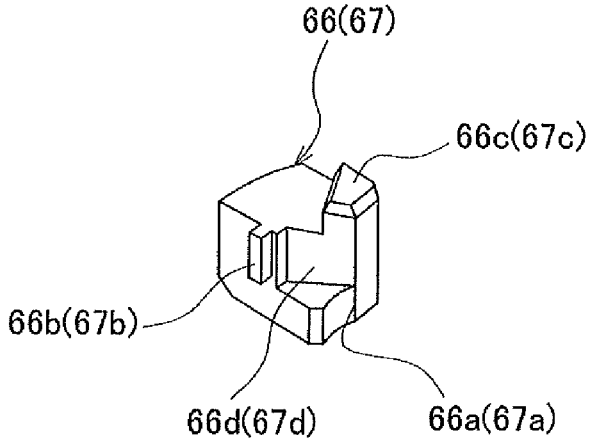
FIG. 22 is a perspective view of a portion corresponding to craw portions of a slide hinge as shown in FIG. 19.
Figure 23:
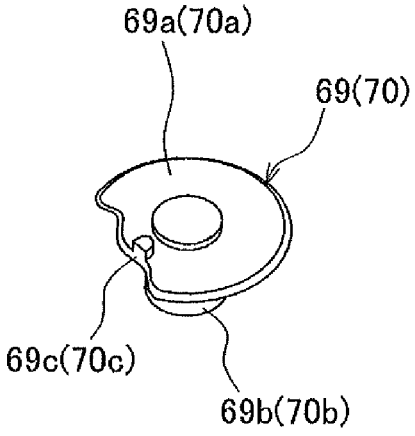
FIG. 23 is a perspective view of an operating plate of a slide hinge as shown in FIG. 19, which is seen from the rear side.
Figure 24:
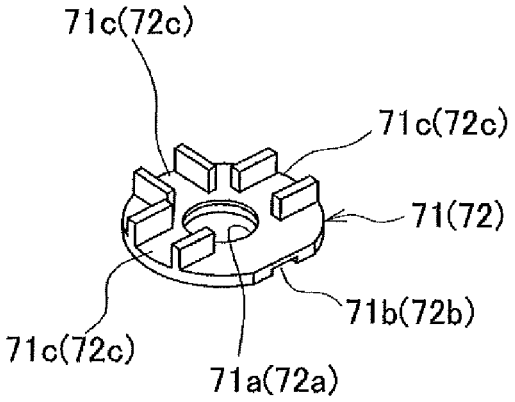
FIG. 24 is a perspective view of a cap of a slide hinge as shown in FIG. 19, which is seen from the rear side.

As described above, the coupling case 62 is fitted into the attaching hole 2*c* provided on the door 2*b*, while the attaching means 63*a* (63*b*) into the connecting holes 2*d* (2*e*) provided on the door 2*b*. Thereafter, each operating plate 69 (70) is rotated, with the tool such as wrench being mounted on the insertion hole 69*e* (70*e*) provided on the operating plate 69 (70) of the diameter expanding means 68*a* (68*b*), to the point where the respective vertex points of the triangle mark e provided on the operating plate 69 (70) and of the triangle mark f provided on the cap 71 (72) meet each other, as shown in FIG. 2. At this point, as shown in FIGS. 20 and 25B to 25C, a pressurizing action by the second pressurizing portions 69*f* (70*f*) on the second pressure receiving portion 66*c* (67*c*) of each craw portion 66*c* (67*c*) is released and a pressurizing action is now applied by the first pressurizing portions 69*d* (70*d*) on the first pressure receiving portion 66*a* (67*a*), so that each craw portion 66 (67) protrudes outward from each through hole 64*a* (65*a*) of the attaching case member 64 (65). At this point, as in Embodiment 1, each craw portion 66 (67) eats into the circumferential wall of honeycomb structure of the connecting hole 2*d* (2*e*) of the door 2*b*, in order to firmly fix the coupling case 62 into the door 2*b*.

In the meantime, stopper means are provided to prevent a rotation of the operating plate 69 (70) more than necessary, when the operating plate 69 (70) is rotated for pushing each craw portion 66 (67) outward. Each stopper means comprises a stopper piece 69*c* (70*c*) provided on the operating plate 69 (70), a guide hole 64*d* (65*d*) provided on a bottom plate 64*c* (65*c*) of each attaching case member 64 (65), the stopper piece 69*c* (70*c*) being fitted into both of the guide holes, as shown in particular in FIG. 23. The stopper means further comprises a stopper piece 66*d* (67*d*) provided on each craw portion 66 (67), as shown in particular in FIG. 22. When the stopper piece 69*c* (70*c*) moves from the start edge portion to the end edge portion of the guide hole 64*d* (65*d*), and then stops, each first pressurizing portion 69*d* (70*d*) forces the craw portions 66 (67) to protrude to the outermost point, so that the craw portions eat into the circumferential wall of the connecting holes 2*d* (2*e*). At this point, the stopper piece 66*b* (67*b*) abuts against the through hole 64*a* (65*a*) to engage with the latter.

Next, in case of replacement of the door 2*b*, or of removal of the coupling case 62 of the slide hinge 60 from the door 2*b* for any other reasons, the operating plate 69 (70) is rotated using tool such as wrench in a direction contrary to as described above (counterclockwise). In this manner, the first pressurizing portions 69*d* (70*d*) is released from a contact with the first pressure receiving portion 66*a* (67*a*), the second pressurizing portions 69*f* (70*f*) is brought into contact with the second pressure receiving portion 66*c* (67*c*), and the craw portions 66 (67) are retracted into the attaching case member 64 (65). Therefore, the coupling case 62 can be removed from the attaching hole 2*c* and the connecting holes 2*d* (2*e*) of the door 2*b*, together with the attaching case member 64 (65), so that the coupling case 62 can be easily removed from the connecting holes 2*d* (2*e*).

Even if the invention is implemented as above described, the object of the invention is achieved, the slide hinge can be easily and repeatedly attached to the cabinet and removed from it.

Embodiment 5

FIGS. 26 to 30 show a further embodiment of a slide hinge according to the invention. The drawings show that a slide hinge 80 according to Embodiment 5 comprises a slide hinge main body 81 attached to a cabinet main body 2*b* shown in FIGS. 1 and 2 of Embodiment 1 and attaching means 82*a*, 82*b* attached to a tip of the slide hinge main body 81 so as to be foldable and unfoldable, and in this manner attached to a door 2*b* equally shown in FIGS. 1 and 2 of Embodiment 1. The attaching means 82*a* (82*b*) shares a coupling case 83 capable of housing the tip side of the slide hinge main body 81, so that the tip side can be advanced and retracted, and comprises an attaching case member 84 (85) connected with both sides of the coupling case 83, a locking plate 86 (87) housed into each attaching case member 84 (85), a diameter expanding means 94*a* (94*b*) for pushing a plurality of craw portions 86*a*; 86*a*; 86*a* (87*a*; 87*a*; 87*a*) in order to expand a diameter of a circle made of the craw portions. Still further, the diameter expanding means 94*a* (94*b*) comprises an operating plate 88 (89) and a cap 90 (91).

Furthermore, in a slide hinge 80 according to Embodiment 5, an attaching case member 84 (85) and a cap 90 (91) respectively have a structure different from that of Embodiment 1. Of other elements, those with an identical reference numeral are identical to those of Embodiment 1.

Moreover, a slide hinge main body 81 of a slide hinge 80 is a pressed part of metal in the known structure, but can be equally a molded part of synthetic resin, as in other embodiments. Reference numerals 81*b*, 81*b* denote attaching pieces used for attaching the slide hinge main body 81 onto a cabinet 2*a*, as shown in FIGS. 1 and 2. Attaching holes 81*a*, 81*a* are provided on the respective attaching pieces 81*b*, 81*b*.

Respective one end portions of a first coupling piece 92*a* and a second coupling piece 92*b* are rotatably coupled via a first hinge pin 95*a* and a second hinge pin 95*b* to an end portion of a slide hinge main body 81 on a side opposite to the side with attaching pieces 81*b*, 81*b*. Respective other end portions of a first coupling piece 92*a* and a second coupling piece 92*b* are rotatably coupled via a third hinge pin 93*a* and a fourth hinge pin 93*b* in the shape of two long bars of the letter U made up by bending a coupling member 93 to coupling holes 83*b*, 83*c* provided on coupling portions 83*a*, 83*a* of a coupling case 83.

A coupling case 83 is a molded part e.g. of synthetic resin having substantially a cup-like shape, and comprises coupling portions 83*a*, 83*a* provided with coupling holes 83*b*, 83*c*, and a housing concave portion 83*d* for housing the tip of a slide hinge main body 81. Attaching case members 84, 85 are provided on the both sides of the hinge main body 81 so as to be united with the latter, with the attaching case members sharing a partition wall 83*e*, 83*e*.

Each attaching case member 84 (85) comprises three through holes 84*a*; 84*a*; 84*a* (85*a*; 85*a*; 85*a*) and an engagement hole 84*b* (85*b*) on a circumferential wall of the attaching case member, wherein the engagement hole 84*b* (85*b*) is provided toward a partition wall 83*e*, 83*e* of a coupling case 83. Two locking pieces 84*a*; 84*a* (85*a*; 85*a*) to which a cap 90 (91) facing inward is attached protrude from an upper edge of each attaching case member 84 (85), and a bearing hole 84*g* (85*g*) are provided on a central portion of a bottom plate of each attaching case member 84 (85) in an axial direction.

Each locking plate 86 (87) comprises locking pieces 86*b*; 86*b*; 86*b* (87*b*; 87*b*; 87*b*) having a disc-like shape in a plan view and erected as spaced apart from each other at predetermined intervals, wherein each of the locking pieces has a craw portion 86*a*; 86*a*; 86*a* (87*a*; 87*a*; 87*a*). The locking pieces 86*b*; 86*b*; 86*b* (87*b*; 87*b*; 87*b*) are so formed that they are inclined to the interior. In this manner, each craw portion 86*a*; 86*a*; 86*a* (87*a*; 87*a*; 87*a*) is housed in the inside of each through hole 84*a*; 84*a*; 84*a* (85*a*; 85*a*; 85*a*) on an attaching case member 84 (85), without protruding from the through hole.

An operating plate 88 (89) is rotatably housed into a locking plate 86 (87) and comprises a plurality of pressurizing portions 88*a*; 88*a*; 88*a* (89*a*; 89*a*; 89*a*) protruding from an outer circumference of the operating plate in a radial pattern. An insertion hole 88*b* (89*b*) into which e.g. wrench is inserted is provided above a tool mounting portion 88*c* (89*c*) provided toward an upper portion on a central portion of the operating plate 88 (89), while a stopper piece 88*d* (89*d*) passing through a first guide hole 86*c* (87*c*) provided on each locking plate 86 (87) and a second guide hole 84*f* (85*f*) provided on each attaching case member 84 (85) is provided downward from one side portion of the operating plate 88 (89).

In Embodiment 5, each cap 90 (91) has substantially a disc-like shape. A bearing hole 90*a* (91*a*) into which a tool is inserted is provided on a central portion of each cap 90 (91) in an axial direction, and a locking piece 90*b* (91*b*) (of which only one is shown) which is inserted into and locked by an engagement hole 84*b* (85*b*) provided on an attaching case member 84 (85) is provided on one side of an outer circumference of each cap 90 (91); what is described here is evident from a comparison between all the references to the cap 90 (91) in the drawings with regard to Embodiment 5. Still further, a pair of engagement concave portions 90*c*; 90*c* (91*c*, 91*c*) are provided on the outer circumference of each cap 90 (91) at an interval of 120° from the locking piece 90*b* (91*b*), wherein these engagement concave portions are locked by locking pieces 84*a*; 84*a* (85*a*; 85*a*) provided on an attaching case member 84 (85).

In the meantime, a plurality of notches 84*e*; 84*e* (85*e*; 85*e*) is provided on a bottom plate 84*d* (85*d*) of an attaching case member 84 (85), on base portions in the area forming an outer wall. Still further, a boss portion 86*g* (87*g*) is provided on a central portion of a bottom plate 86*f* (87*f*) of a locking plate 86 (87), wherein a bearing hole 86*d* (87*d*), into which a shaft portion 88*e* (89*e*) of an operating plate 88 (89) is housed, is provided on the boss portion. The boss portion 86*g* (87*g*) is inserted into and supported by a bearing hole 84*g* (85*g*) provided on a bottom plate 84*d* (85*d*) of an attaching case member 84 (85). Still further, a plurality of notches 86*e* (87*e*) is provided over base portions of the locking pieces 86*b* (87*b*), on a circumference of a bottom plate 86*f* (87*f*) of the locking plate 86 (87).

Triangle marks g, h are provided respectively in the area of a tool mounting portion 88*c* (89*c*) of an operating plate 88 (89) and in the vicinity of a bearing hole 90*a* (91*a*) of the cap 90 (91). Still further, each operating plate 88 (89) comprises a shaft portion 88*e* (89*e*) extending downward from the tool mounting portion 88*c* (89*c*). Therefore, the tool mounting portion 88*c* (89*c*) is pivotally supported by the bearing hole 90*a* (91*a*) of the cap 90 (91), and a pivotally supporting portion 88*f* (89*f*) of smaller diameter provided on a tip of the shaft portion 88*e* (89*e*) is inserted into and supported by the bearing hole 86*d* (87*d*) of a locking plate 86 (87), so that the operating plate 88 (89) assures a stable rotational movement with no shaft wobble during a rotation of the shaft portion 88*e* (89*e*).

Still further, a boss portion 86*g* (87*g*) of a locking plate 86 (87) is pivotally supported by a bearing hole 84*g* (85*g*) of an attaching case member 84 (85), craw portions 86*a*; 86*a*; 86*a* (87*a*; 87*a*; 87*a*) can be equally pushed out of an attaching case member 84 (85) via respective through holes 84*a*; 84*a*; 84*a* (85*a*; 85*a*; 85*a*), so that the locking plate 86 (87) has an advantage of stable attached state.

Next, an attaching procedure of the slide hinge 80 according to the invention into the cabinet 2 as shown in FIGS. 1 and 2 of Embodiment 1 is identical the procedure in other embodiments. However, under normal conditions, each craw portion 86*a*; 86*a*; 86*a* (87*a*; 87*a*; 87*a*) does not protrude outside from a corresponding through hole 84*a*; 84*a*; 84*a* (85*a*; 85*a*; 85*a*) provided on the attaching case member 84 (85), so the slide hinge has an advantage that it appears to be slimmed down, and the coupling case 83 and the attaching case members 84, 85 can be easily inserted into the attaching hole 2*c* and the connecting holes 2*d*, 2*e* provided on the door 2*b*. Still further, when the coupling case 82 of the slide hinge 80 is removed from the door 2*b* after installation, the operating plate 88 (89) is rotated counterclockwise. In this manner, the craw portions 86*a*; 86*a*; 86*a* (87*a*; 87*a*; 87*a*) are automatically retracted into the attaching case member 84 (85) relative to respective through holes 84*a*; 84*a*; 84*a* (85*a*; 85*a*; 85*a*). Therefore, the slide hinge 80 has an advantage that the coupling case 83 and the attaching case members 84, 85 can be easily removed from the attaching hole 2*c* and the connecting holes 2*d*, 2*e*.

In attaching the locking plate 86 (87), the operating plate 88 (89) and the cap 90 (91) to the attaching case member 84 (85), the locking plate 86 (87) is first inserted into the attaching case member 84 (85), with the first guide hole 86*c* (87*c*) being aligned with the second guide hole 84*f* (85*f*). In doing so, each craw portion 86*a*; 86*a*; 86*a* (87*a*; 87*a*; 87*a*) can be so structured that it is fitted into each through hole 84*a*; 84*a*; 84*a* (85*a*; 85*a*; 85*a*), so as to prevent protrusion outward, and in this case, the insertion position of each craw portion is further stabilized. Then, the stopper piece 88*d* (89*d*) of the operating plate 88 (89) is inserted into the first guide hole 86*c* (87*c*) and the second guide hole 84*f* (85*f*), both holes overlapping each other, and placed at the start edge portion of the both holes. At this point, each pressurizing portion 88*a*; 88*a*; 88*a* (89*a*; 89*a*; 89*a*) is placed between the corresponding craw portions 86*a*; 86*a*; 86*a* (87*a*; 87*a*; 87*a*). Then, the top of the attaching case member 84 (85) is covered with the cap 90 (91), which is then locked as above described. Their attaching procedure is thus accomplished.

Figure 29:
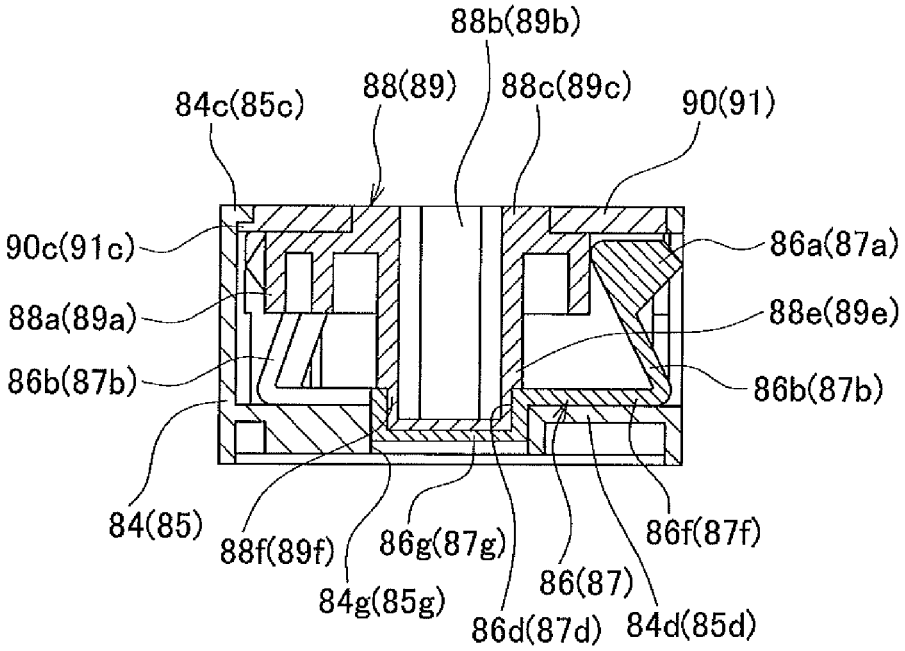
FIG. 29 is a vertical sectional view showing a portion corresponding to one attaching means of a slide hinge as shown in FIG. 26.
Figure 30:
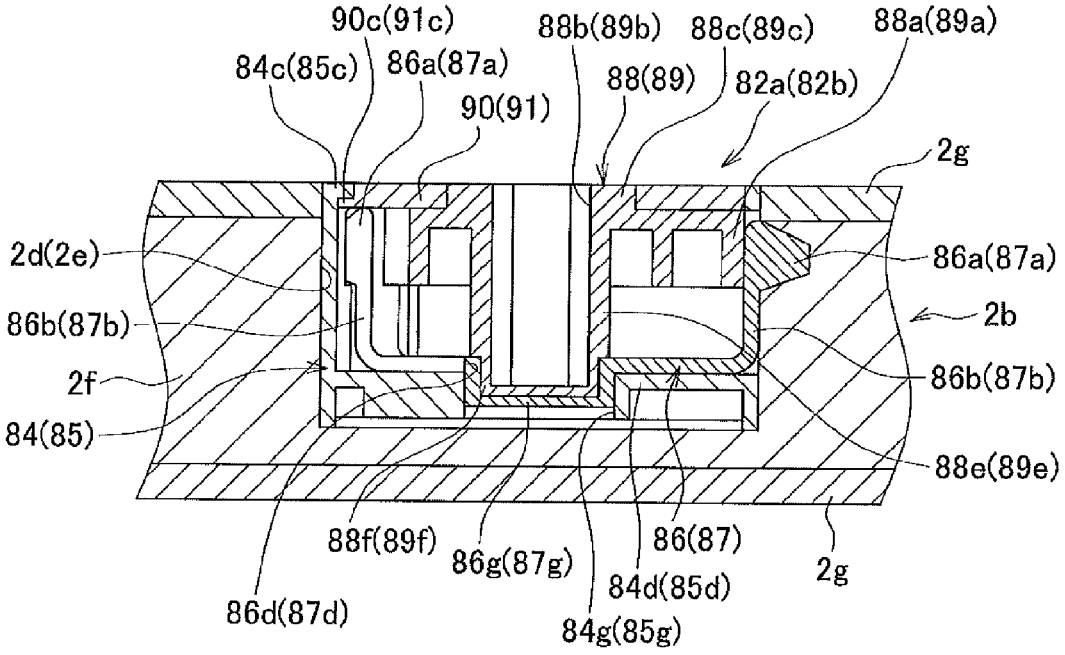
FIG. 30 is a vertical sectional view showing one attaching means of a slide hinge as shown in FIG. 26, which is attached to a door.

In attaching the slide hinge 80 to the cabinet 2, the attaching pieces 81*b*, 81*b* of the slide hinge main body 81 are attached to the cabinet main body 2*a*, using attaching screws 18, 18, as shown in FIGS. 1 and 2 of Embodiment 1. Then, the coupling case 83 is inserted into the attaching hole 2*c* provided on the door 2*b* (in Embodiment 1), while the attaching means 82*a* (82*b*) into the connecting holes 2*d* (2*e*) provided on the door 2*b* (in Embodiment 1). FIG. 29 shows a cross section of an inserted state of the attaching case member 84 (85) of the attaching means 82*a* (82*b*) into the connecting holes 2*d* (2*e*).

Thereafter, each operating plate 88 (89) is rotated clockwise, with the tool such as wrench being mounted on the insertion hole 88*c* (89*c*) provided on the operating plate 88 (89), to the point where the respective vertex points of the triangle mark g provided on the operating plate 88 (89) and of the triangle mark h provided on the cap 90 (91) meet each other. At this point, each pressurizing portion 88*a*; 88*a*; 88*a* (89*a*; 89*a*; 89*a*) pushes outward the corresponding craw portion 86*a*; 86*a*; 86*a* (87*a*; 87*a*; 87*a*) of each locking piece 86*b*; 86*b*; 86*b* (87*b*; 87*b*; 87*b*) of each locking plate 86 (87), so that the craw portion 86*a*; 86*a*; 86*a* (87*a*; 87*a*; 87*a*) protrudes outward from each through hole 84*a*; 84*a*; 84*a* (85*a*; 85*a*;

85*a*) of the attaching case member 84 (85). At this point, as a representative example shown in FIG. 30, each craw portion 86*a*; 86*a*; 86*a* (87*a*; 87*a*; 87*a*) eats into the circumferential wall of honeycomb structure of the connecting hole 2*d* (2*e*) of the door 2*b*, in order to firmly fix the coupling case 83 into the door 2*b*.

Figure 27:
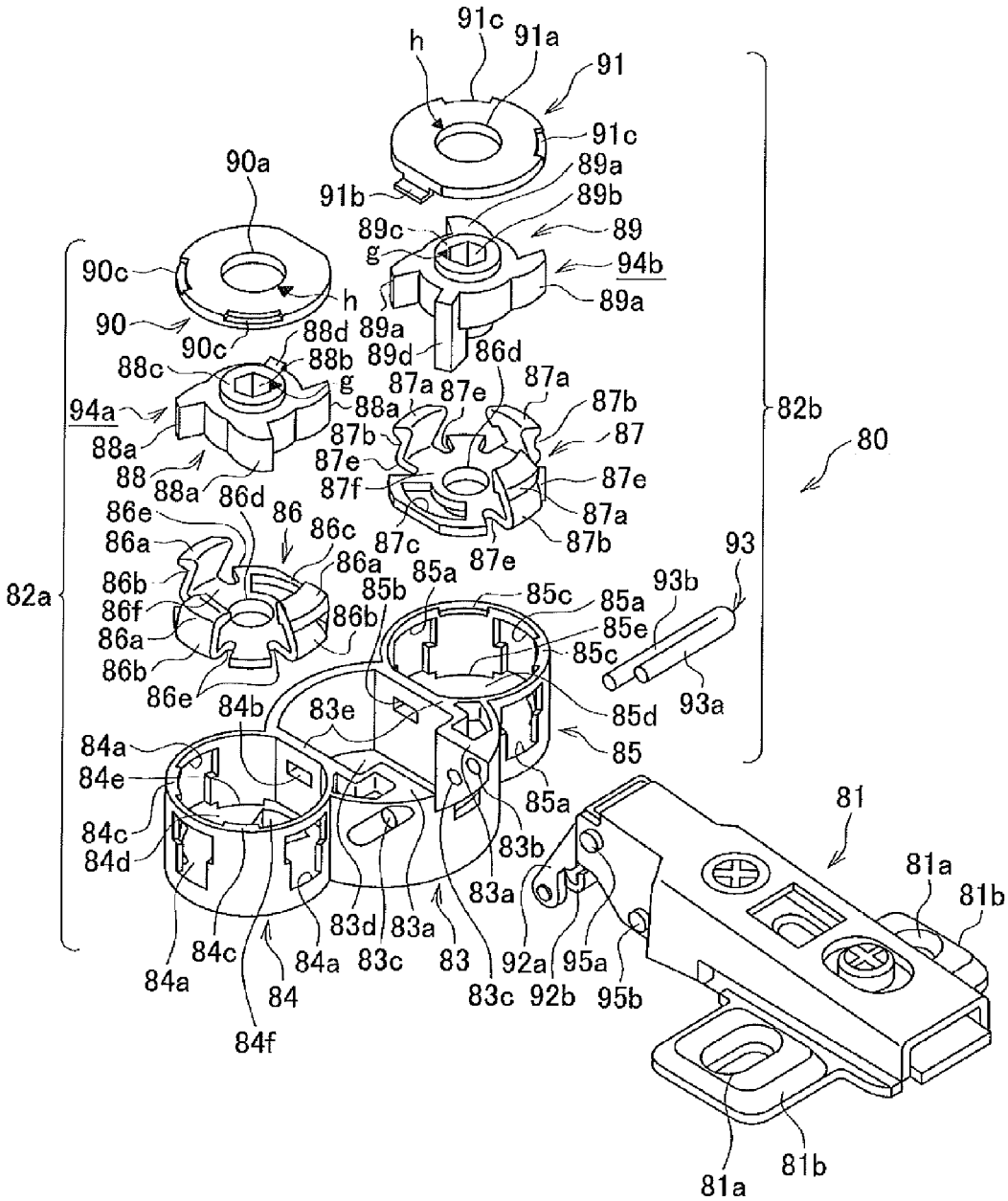
FIG. 27 is an exploded perspective view of a slide hinge as shown in FIG. 26.
Figure 28:
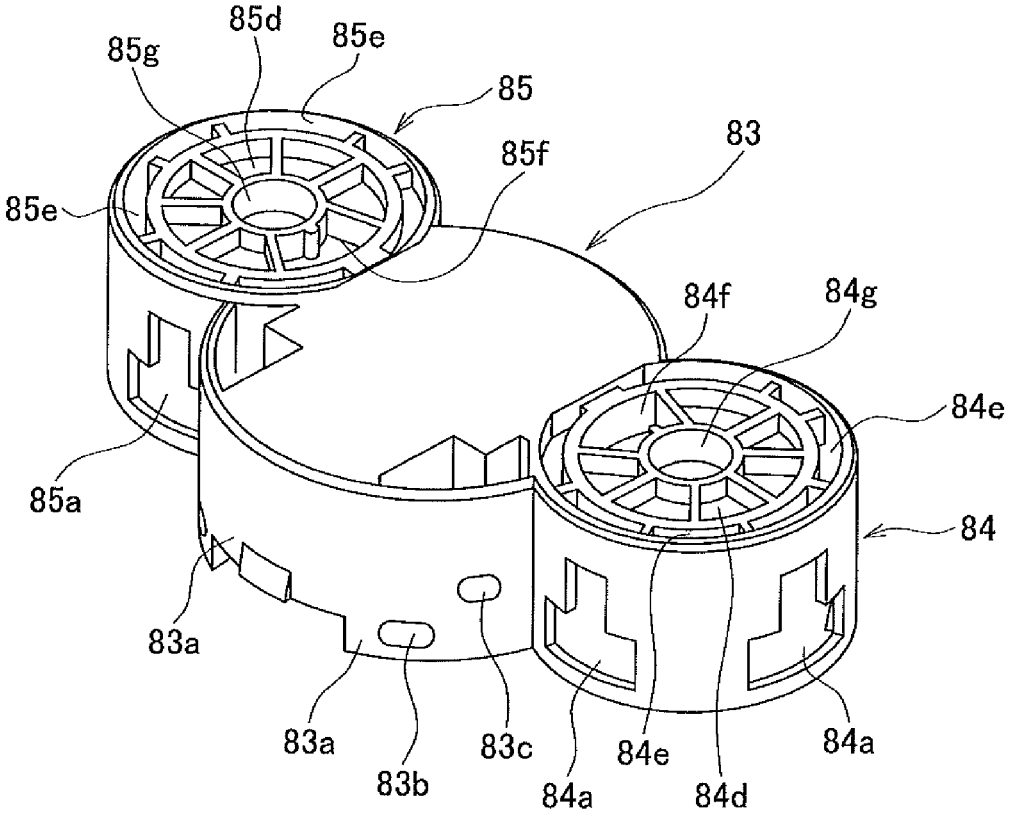
FIG. 28 is a perspective view showing a coupling case and an attaching case member of a slide hinge as shown in FIG. 26, which is seen from the rear side.

In the meantime, stopper means (not shown using reference numeral) are provided to prevent a rotation more than necessary, when an operating plate 88 (89) is rotated. Each stopper means comprises a stopper piece 88*d* (89*d*) provided on the operating plate 88 (89), a first guide hole 86*c* (87*c*) provided on each locking plate 86 (87) and a second guide hole 84*f* (85*f*) provided on each attaching case member 84 (85), wherein the stopper piece is fitted into both of the guide holes, as shown in FIG. 27. When the stopper piece 88*d* (89*d*) moves from the start edge portion to the end edge portion, respectively of the second guide hole 84*f* (85*f*) and the first guide hole 86*c* (87*c*), and then stops, each pressurizing portion 88*a*; 88*a*; 88*a* (89*a*; 89*a*; 89*a*) forces the craw portion 86*a*; 86*a*; 86*a* (87*a*; 87*a*; 87*a*) to protrude to the outermost point, so that the craw portions eat into the circumferential wall of the connecting holes 2*d* (2*e*), as partially shown in FIG. 30.

Still further, stopper means can be also constructed by providing pressurizing portion 88*a*; 88*a*; 88*a* (89*a*; 89*a*; 89*a*) of an operating plate 88 (89) with projections at the points where the operating plate 88 (89) abuts against the craw portion 86*a*; 86*a*; 86*a* (87*a*; 87*a*; 87*a*) after a rotation to a predetermined angle. If constructed as above described, the structure of the stopper means is further simplified, which allows for further cost reduction.

Since the invention is constructed as in the foregoing, it is suitable for use in various sorts of furniture, such as cabinet, made of a board using a cardboard honeycomb core for ordinary household or office.

What is claimed is:

1. A slide hinge comprising a slide hinge main body attached to a cabinet main body, a coupling case inserted and fixed into an attaching hole provided on a door side, and coupling pieces coupling said coupling case to said hinge main body, so that said coupling case is openable and closable relative to said hinge main body, wherein a pair of attaching means which can be attached to said door side even without using attaching screws are provided, wherein each of said attaching means comprises an attaching case member integrally connected to both side portions of said coupling case, a locking plate having craw portions provided so as to protrude outside from said attaching case member, said locking plate housed in said attaching case member, and a diameter expanding means pushing out said craw portions of said locking plate, so that said craw portions protrude outward, and wherein said diameter expanding means comprises an operating plate having a plurality of pressurizing portions rotatably housed in said locking plate and protruding from an outer circumference of said operating plate and a shaft portion having a tool mounting portion toward a tip on a central portion, a rotation angle of said operating plate being controlled by a stopper means within a predetermined range, and a cap having a bearing hole for pivotally supporting said shaft portion on a central portion of said cap, said cap being so attached to said attaching case member that said cap is attachable and detachable.

2. The slide hinge according to claim 1, wherein said stopper means of said operating plate is made up of stopper pieces provided on said operating plate, each of said stopper pieces passing through a first guide hole provided on said locking plate and a second guide hole provided on said attaching case member.

3. The slide hinge according to claim 1, wherein said stopper means of said operating plate is projections provided on said pressurizing portions of said operating plate.

4. A slide hinge comprising a slide hinge main body attached to a cabinet main body, a coupling case inserted and fixed into an attaching hole provided on a door side, and coupling pieces coupling said coupling case to said hinge main body, so that said coupling case is openable and closable relative to said hinge main body, wherein a pair of attaching means which can be attached to said door side even without using attaching screws are provided, wherein each of said attaching means comprises an attaching case member integrally connected to both side portions of said coupling case, craw portions provided so as to be swingable outward of said attaching case member, and a diameter expanding means pushing out said craw portions of said locking plate, so that said craw portions protrude outward, and wherein said diameter expanding means comprises an operating plate having a plurality of pressurizing portions rotatably housed in said locking plate and protruding from an outer circumference of said operating plate and a shaft portion having a tool mounting portion toward a tip on a central portion, a rotation angle of said operating plate being controlled by a stopper means within a predetermined range, and a cap having a bearing hole for pivotally supporting said shaft portion on a central portion of said cap, said cap being so attached to said attaching case member that said cap is attachable and detachable.

5. A slide hinge comprising a slide hinge main body attached to a cabinet main body, a coupling case inserted and fixed into an attaching hole provided on the door side, and coupling pieces coupling said coupling case to said hinge main body, so that said coupling case is openable and closable relative to said hinge main body, wherein a pair of attaching means which can be attached to said door side even without using attaching screws are provided, wherein each of said attaching means comprises an attaching case member integrally connected to both side portions of said coupling case, a locking plate having craw portions provided so as to protrude outside from said attaching case member, said locking plate housed in said attaching case member, and a diameter expanding means pushing out said craw portions of said locking plate, so that said craw portions protrude outward, and wherein said diameter expanding means is made up of a cap press-fitted into said operating plate, so that said cap expands a diameter of said craw portions, said cap being so locked by said attaching case member that said cap is attachable and detachable.

6. A slide hinge comprising a slide hinge main body attached to a cabinet main body, a coupling case inserted and fixed into an attaching hole provided on a door side, and coupling pieces coupling said coupling case to said hinge main body, so that said coupling case is openable and closable relative to said hinge main body, wherein a pair of attaching means which can be attached to said door side even without using attaching screws are provided, wherein each of said attaching means comprises an attaching case member integrally connected to both side portions of said coupling case, a plurality of craw portions provided so as to protrude outside from said attaching case member, each of said craw portions having a first pressure receiving portion and a second pressure receiving portion and a diameter expanding means pushing out said craw portions of said locking plate, so that said craw portions protrude outward, wherein said diameter expanding means comprises an operating plate having a shaft portion, a tool mounting portion provided on said shaft portion, a plurality of first pressurizing portions protruding on an outer circumference of said shaft portion and a plurality of second pressurizing portions protruding on an outer circumference of said shaft portion, said operating plate being rotatably housed into said attaching case member, a cap having a bearing hole for pivotally supporting said shaft portion of said operating plate and a guide groove for guiding said craw portions so that said craw portions are swingable, said cap being so locked by said attaching case member that said cap is attachable and detachable.

7. A slide hinge comprising a slide hinge main body attached to a cabinet main body, a coupling case inserted and fixed into an attaching hole provided on a door side, and coupling pieces coupling said coupling case to said hinge main body, so that said coupling case is openable and closable relative to said hinge main body, wherein a pair of attaching means which can be attached to said door side even without using attaching screws are provided, wherein each of said attaching means comprises an attaching case member integrally connected to both side portions of said coupling case, a locking plate having craw portions provided so as to protrude outside from said attaching case member, said locking plate being pivotally supported by and housed into said attaching case member, and a diameter expanding means pushing out said craw portions of said locking plate, so that said craw portions protrude outward, wherein said diameter expanding means comprises an operating plate having a plurality of pressurizing portions pivotally supported by and rotatably housed into said locking plate, said pressurizing portions protruding on an outer circumference of said locking plate, a tool mounting portion provided toward a tip on a central portion of said locking plate, a rotation angle of said operating plate being controlled by a stopper means within a predetermined range, a cap having a bearing hole for pivotally supporting said tool mounting portion, said cap being so attached to said attaching case member that said cap is attachable and detachable.

8. The slide hinge according to claim 1, wherein each of said craw portions is housed into said attaching case member.

9. The slide hinge according to claim 1, wherein said attaching hole of said coupling case is provided on said cabinet main body.

* * * * *